US009428885B2

(12) United States Patent
Nau

(10) Patent No.: US 9,428,885 B2
(45) Date of Patent: Aug. 30, 2016

(54) GUIDANCE SYSTEM FOR EARTHMOVING MACHINERY

(71) Applicant: Trimble Navigation Limited, Sunnyvale, CA (US)

(72) Inventor: Kevin Ray Nau, New Carlisle, OH (US)

(73) Assignee: Trimble Navigation Limited, Sunnyvale, CA (US)

( * ) Notice: Subject to any disclaimer, the term of this patent is extended or adjusted under 35 U.S.C. 154(b) by 43 days.

(21) Appl. No.: 14/486,463

(22) Filed: Sep. 15, 2014

(65) Prior Publication Data

US 2016/0076228 A1 Mar. 17, 2016

(51) Int. Cl.

| | |
|---|---|
| ***E02F 3/04*** | (2006.01) |
| ***E02F 9/26*** | (2006.01) |
| ***E02F 3/43*** | (2006.01) |
| ***E02F 3/84*** | (2006.01) |

(52) U.S. Cl.

CPC ..... *E02F 9/261* (2013.01); *E02F 3/435* (2013.01); *E02F 3/842* (2013.01); *E02F 9/26* (2013.01); *E02F 9/264* (2013.01); *E02F 9/265* (2013.01)

(58) Field of Classification Search

USPC ..... 701/50, 469, 408, 468, 32.3, 32.4; 345/630; 414/699; 37/414; 172/811

See application file for complete search history.

(56) References Cited

U.S. PATENT DOCUMENTS

| | | | | |
|---|---|---|---|---|
| 5,343,033 | A | 8/1994 | Cain | |
| 5,471,049 | A | 11/1995 | Cain | |
| 5,486,690 | A | 1/1996 | Ake | |
| 6,112,145 | A * | 8/2000 | Zachman | E02F 3/844 172/190 |
| 6,388,743 | B1 | 5/2002 | Aharon | |
| 7,012,237 | B1 | 3/2006 | Ake | |
| 7,409,312 | B2 | 8/2008 | Conner | |
| 7,414,704 | B1 | 8/2008 | Nau | |

(Continued)

FOREIGN PATENT DOCUMENTS

| | | |
|---|---|---|
| JP | 2010 043446 | 2/2010 |
| WO | WO 95/04917 | 2/1995 |

OTHER PUBLICATIONS

Comparing two measuring methods of soil microtopography; Zongnan Li; Zhongxin Chen ; Agro-Geoinformatics (Agro-Geoinformatics), 2012 First International Conference on; Year: 2012; pp. 1-4, DOI: 10.1109/Agro-Geoinformatics.2012.6311679.*

(Continued)

*Primary Examiner* — Cuong H Nguyen

(74) *Attorney, Agent, or Firm* — Frederick H. Gribbell; Aaron S. Brodsky

(57) ABSTRACT

Disclosed is a guidance system that helps an earthmoving machine operator to control exactly to what elevation to dig. The system includes an electronic sensing device and a display monitor. In one embodiment, the electronic sensing device includes a distance measuring sensor (LDM), an elevation detecting sensor, an orientation sensor, and a steering mechanism for the LDM. The sensing device is mounted to an earthmoving machine, and sends signals to the display showing the machine operator where to move the digging tool for digging to the desired elevation. The various sensors in the sensing device are calibrated at the factory, so the sensing device can be mounted to an earthmoving machine and then be immediately used by that machine without needing any calibration that involves the machine itself, which is a huge advantage for the equipment operator. The measurements are made via non-contact sensors, thereby preserving the jobsite surface.

21 Claims, 21 Drawing Sheets

(56) References Cited

U.S. PATENT DOCUMENTS

| | | | | |
|---|---|---|---|---|
| 7,949,449 | B2 * | 5/2011 | Koch | E02F 9/265 37/414 |
| 8,145,394 | B2 | 3/2012 | Chiorean | |
| 8,363,210 | B2 | 1/2013 | Montgomery | |
| 8,634,991 | B2 * | 1/2014 | Douglas | E02F 3/847 172/4.5 |
| 8,843,279 | B2 * | 9/2014 | Tafazoli Bilandi | B66C 13/46 404/72 |
| 2006/0041361 | A1 * | 2/2006 | Matrosov | E02F 3/842 701/50 |
| 2009/0202109 | A1 * | 8/2009 | Clar | G01C 15/00 382/104 |
| 2013/0235079 | A1 * | 9/2013 | Reitan | G06F 3/011 345/633 |
| 2014/0074360 | A1 * | 3/2014 | Rosa | G05D 3/12 701/50 |
| 2014/0149004 | A1 * | 5/2014 | Best | G06F 19/00 701/50 |
| 2015/0081176 | A1 * | 3/2015 | Paull | E02F 3/401 701/50 |
| 2015/0292179 | A1 * | 10/2015 | Joergensen | G01C 15/004 701/50 |

OTHER PUBLICATIONS

Shallow Angle Wave Profiling LIDAR; Belmont, M.R.; Horwood, J.M.K.; Thurley, R.W.F.; Baker, J.; Current Measurement Technology, 2008. CMTC 2008. IEEE/OES 9th Working Conference on; Year: 2008; pp. 217-223, DOI: 10.1109/CCM.2008.4480871.*

Research on Rapid Measurement of Medium Short Wave Longitudinal Road Profiles; Yang Diange; Han Yi; Lian Xiaomin Electrical and Control Engineering (ICECE), 2010 International Conference on; Year: 2010; pp. 1742-1745, DOI: 10.1109/iCECE.2010.429.*

Load management using smart supervisory in a distributed smart grid; Ally Mbarushimana; Xin Ai Electric Utility Deregulation and Restructuring and Power Technologies (DRPT), 2011 4th International Conference on Year: 2011; pp. 1113-1120, DOI: 10.1109/DRPT.2011.5994062.*

ISA International Search Report (Jan. 22, 2015).

ISA Written Opinion (Jan. 22, 2015).

* cited by examiner

GUIDANCE SYSTEM FOR EARTHMOVING MACHINERY

TECHNICAL FIELD

The technology disclosed herein relates generally to earthmoving equipment and is particularly directed to a guidance and sensing system of the type which helps the machine operator to control exactly where, and to what elevation, to dig or grade. Embodiments are specifically disclosed as an electronic apparatus (or "sensing device") that includes at least one orientation sensor and an electronic distance measuring sensor, and in some embodiments the apparatus also includes a position sensor and a steering mechanism for the distance sensor. The sensing device is mounted to an earthmoving machine, and provides signals to a display that is viewable by the machine operator, for showing that operator the excavation progress towards, and the correct elevation to dig or grade.

In most of the embodiments disclosed herein, the "basic system" of the technology can be mounted to an earthmoving machine with less effort than conventional guidance systems and then immediately be used by that machine, without needing any calibration to the machine itself. Instead, the sensing device is calibrated at the factory, so that its sensors are essentially ready to go, "as is;" it does not make any difference what the dimensions are of the earthmoving machine for these embodiments. This is a huge advantage for the equipment operator, because that operator can easily install the system and begin working without waiting for any machine calibration measurements and procedures to be performed.

The "basic system" of the technology uses two main components: (1) a sensing device (the apparatus) typically installed on one of the machine's members for a good "view" of the excavation, and (2) a display monitor that can be seen by the machine's operator in the cab. These two components require less installation effort compared to the typical five or more components of conventional systems. The sensing device typically includes a laser distance meter (LDM) with a steering mechanism that moves the LDM's laser sensing output beam and measures its orientation; also there is an electronic orientation sensor (EOS), that measures the orientation of the sensing device (typically an angle sensor, sensitive to gravity), and a position sensing unit (PS) that measures the position of the sensing device relative to a known location on the worksite (jobsite). With these sensor inputs, the sensing device can communicate to the display monitor the present location of the jobsite surface with respect to a desired elevation or profile for making the dig, and in some circumstances their relative positions are able to be displayed in substantially real time.

The "basic system" can be factory-calibrated, as noted above; in other words, all of the various sensors provided with the sensing device are installed and accurately calibrated before the sensing device ever leaves the factory. Such an "integrated sensing device" can then be mounted to a member of an earthmoving machine without any "field" calibration to that machine, and used immediately for the purposes described in the previous paragraph.

In alternative embodiments, the steerable LDM potentially can scan the working tool and identify its digging edge, such as the teeth of the bucket of an excavator. From that information the sensing system can determine the relative positions of the digging edge and the desired elevation for making the dig, and display those positions on the operator's monitor.

STATEMENT REGARDING FEDERALLY SPONSORED RESEARCH OR DEVELOPMENT

None.

BACKGROUND

Earthmoving machines are well-known types of construction equipment, and are generally used for digging, grading, or otherwise placing dirt, rocks, or other material involved in the building of a construction project, according to a jobsite plan. Common types of earthmoving machines are excavators, bulldozers, graders, front-end loaders, backhoes, trenchers, compactors, screeds, pavers, and the like.

When digging a trench or a ditch, such earthmoving machines need to be guided with respect to using their working tools to create a desired dig elevation or a desired profile for a ditch or trench. Modern electronic devices are typically used to assist the operator of such earthmoving machines. In conventional systems, various different types of sensing components typically are individually installed at different locations on the machine itself during an "installation" step. Each of those sensing components then must be calibrated to the particular machine member that it has been mounted to, and the geometric dimensions of the instrumented members must be measured and entered into system memory during a "machine calibration" step. Finally the operator must align the on board position sensor(s) to jobsite coordinates during a "benching" step, before the operator can perform any useful tasks.

Construction projects are built in more than one stage. Before any digging can be satisfactorily performed, the jobsite must be surveyed and marked (or "staked"). Laying out the surveyed jobsite to create the physical benchmarks can be considered a "Stage One" phase of the project. After Stage One is completed, the digging can begin; this can be considered a "Stage Two" of the project. For "old" jobsites where the buildings and utility lines are already in existence, Stage One includes "finding" certain important objects before the Stage Two digging begins, especially if the important objects are below ground level.

In U.S. Pat. No. 8,363,210 (by Montgomery), an excavator machine is instrumented with a laser rangefinder mounted on the dipperstick, with gravity sensors mounted under the cab, and with angle encoders mounted at the joint of the boom and stick, and at the joint of the stick and bucket. After these sensors are installed on the machine, all the sensors must be calibrated to the machine itself before the appropriate machine dependent set-offs can be determined and the system can be used. The Montgomery patent discloses an electronic system that assists in performing some of the tasks for Stage One, noted above. The electronic system is told the jobsite ground coordinates of where a "feature" should be located, and then the excavator physically approaches that feature and aims the laser rangefinder at the precise expected location of that feature. Some features are underground, so the laser rangefinder is also used to determine how far below the ground level that feature is supposed to be. The purpose of all this is so the excavator machine operator can easily find and then properly identify that feature. Once that specific feature has been found and identified, the electronic system can determine the three-dimensional coordinates of that "found feature," and can electronically mark that set of coordinates so this data can be loaded by engineers into an "as-built drawing." In essence, Montgomery discloses a new type of surveying system for a completed, or nearly-completed, construction site. All of the sensors in Montgomery's system must be calibrated to the machine itself.

SUMMARY

Accordingly, it is an advantage to provide an integrated guidance and sensing system of the type which shows the operator of an earthmoving machine the relative elevation needed for digging (or grading) material on the surface of a jobsite, by using an electronic distance measuring sensor to scan an area of the jobsite surface and an orientation sensor to determine the orientation of the scanned data to gravity, and optionally the local magnetic field (magnetic north), after a benching procedure involving a feature of known coordinates (a "benchmark") at the jobsite, to show on a display monitor a "design profile" that displays to the operator a desired final dig profile, along with a "latest profile" that displays the current actual position of the jobsite surface, all on the same Y-Z axes on the monitor screen, so the machine operator can see exactly which portion of the design profile still needs to be contoured. The term "elevation" used herein is to imply the determination of vertical positions and, as needed, the determination of corresponding horizontal positions.

It is another advantage to provide an integrated guidance and sensing system of the type which shows the operator of an earthmoving machine the elevation needed for digging (or grading) material on the surface of a jobsite, by using an electronic distance measuring sensor to scan an area of the jobsite surface, a position sensor to determine a current elevation as compared to a known elevation reference on that jobsite, and an orientation sensor to determine the orientation of the scanned data to gravity and optionally magnetic north, and to show on a display monitor a "design profile" that displays to the operator a desired final dig profile, along with a "latest profile" that displays the current actual position of the jobsite surface, all on the same Y-Z axes on the monitor screen, so the machine operator can see exactly which portion of the design profile still needs to be contoured.

It is yet another advantage to provide an integrated guidance and sensing system of the type which shows the operator of an earthmoving machine the elevation needed for digging (or grading) material on the surface of a jobsite, by using an electronic distance measuring sensor to scan an area of the jobsite surface, a position sensor to determine a current elevation as compared to a known elevation reference on that jobsite, and an orientation sensor to determine the orientation of the scanned data to gravity and optionally magnetic north, and to show on a display monitor a "design profile" that displays to the operator a desired final dig profile, along with a "latest profile" that displays the current actual position of the jobsite surface, all on the same Y-Z axes on the monitor screen, and includes the ability for being used immediately after being mounted to a member of the earthmoving machine, without needing a calibration procedure to "mate" the sensing system to the machine.

It is still another advantage to provide an integrated guidance and sensing system of the type which shows the operator of an earthmoving machine the elevation needed for digging (or grading) material on the surface of a jobsite, by using a steerable electronic distance measuring sensor to scan an area of the jobsite surface and an orientation sensor to determine the orientation of the scanned data to gravity and optionally magnetic north, and to show on a display monitor a "design profile" that displays to the operator a desired final dig profile, along with a "latest profile" that displays the current actual position of the jobsite surface, all on the same Y-Z axes on the monitor screen, and includes the ability for being used immediately after being mounted to a member of the earthmoving machine, without needing a calibration procedure to "mate" the sensing system to the machine.

It is a further advantage to provide an integrated guidance and sensing system of the type which shows the operator of an earthmoving machine the elevation needed for digging (or grading) material on the surface of a jobsite, by using an electronic distance measuring sensor to scan an area of the jobsite surface, a position sensor to determine a current elevation as compared to a known elevation reference on that jobsite, a boom pivot reference, and an orientation sensor to determine the orientation of the scanned data and a particular member of the earthmoving machine to gravity and optionally magnetic north, and to show on a display monitor a "design profile" that displays to the operator a desired final dig profile, along with a "latest profile" that displays the current actual position of the jobsite surface, all on the same Y-Z axes on the monitor screen, and includes the ability for being used at times when the position sensor's output signal is not valid.

It is still a further advantage to provide an integrated guidance and sensing system of the type which shows the operator of an earthmoving machine the elevation needed for digging (or grading) material on the surface of a jobsite, by using an electronic distance measuring sensor to scan the working tool identifying the working tool edge and scan an area of the jobsite surface, a position sensor to determine the current elevation as compared to a known elevation reference on the jobsite, and an orientation sensor to determine the orientation of the scanned data, and with those sensor inputs, is capable of recognizing a portion of the previously scanned working tool profile and determining the working tool edge position and orientation, then showing on a display monitor a "design profile," a "latest profile," and a working tool image, and showing the position and orientation of the working tool edge, all on the same Y-Z axes.

It is a yet further advantage to provide an integrated guidance and sensing system of the type which shows the operator of an earthmoving machine the elevation needed for digging (or grading) material on the surface of a jobsite, by using an electronic distance measuring sensor to scan an area of the jobsite surface, a position sensor to determine a current elevation as compared to a known elevation reference on that jobsite, a pair of inclinometers mounted to the dipperstick and bucket of the earthmoving machine that may be used to detect the bucket tooth location and orientation, and an orientation sensor to determine the scanned data orientation and an angle of a particular member of the earthmoving machine to gravity and optionally to magnetic north, and to show on a display monitor a "design profile" that displays to the operator a desired final dig profile, along with a "latest profile" that displays the current actual position of the jobsite surface, along with an image of the working tool showing its working edge in its current position and orientation, all on the same Y-Z axes on the monitor screen.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, an integrated sensing device for use with an earthmoving machine that includes a working tool edge apparatus is provided, which comprises: (a) an electronic distance sensor, having a sensing output that is directed at a jobsite surface, which determines a distance between a datum of the sensing output and the jobsite surface without making physical contact with the jobsite surface; (b) an electronic orientation sensor for detecting an angular orientation of the sensing output; and (c) a processing circuit, and a memory circuit; (d) wherein the processing circuit is configured: (i) to receive output signals from the electronic distance sensor and the electronic orientation sensor; and (ii) to send signals to a visible monitor screen, so as to display a "latest profile" that represents an actual shape of the jobsite surface.

In accordance with another aspect, a method for using an integrated sensing device with an earthmoving machine that includes a working tool edge is provided, which method comprises the steps of: (a) providing an integrated sensing device, having: (i) an electronic distance sensor; (ii) an electronic orientation sensor; (iii) a processing circuit; and (iv) a memory circuit; (b) directing a sensing output of the electronic distance sensor toward a jobsite surface, and determining a distance between a datum of the sensing output and the jobsite surface without making physical contact with the jobsite surface; (c) detecting an angular orientation of the sensing output, using the electronic orientation sensor; (d) receiving output signals from the electronic distance sensor and the electronic orientation sensor, and determining a "latest profile" that represents an actual shape of the jobsite surface; and (e) sending signals to a visible monitor screen, and displaying the latest profile.

In accordance with still another aspect, a method for using an integrated sensing device with an earthmoving machine that includes a working tool edge is provided, which method comprises the steps of: (a) providing an integrated sensing device, having: (i) an electronic distance sensor; (ii) an electronic orientation sensor; (iii) a processing circuit; (iv) a memory circuit; and (v) a housing; (b) calibrating the electronic distance sensor and the electronic orientation sensor to the datum and to a direction of gravity without need of earthmoving machine geometry knowledge; (c) later, mounting the integrated sensing device to an earthmoving machine; (d) thereafter, without need for any calibration to the earthmoving machine, determining a "latest profile" that represents an actual shape of the jobsite surface; and (e) sending signals to a visible monitor screen, and displaying the latest profile.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

DETAILED DESCRIPTION

Figures 1, 2, 3, 4:
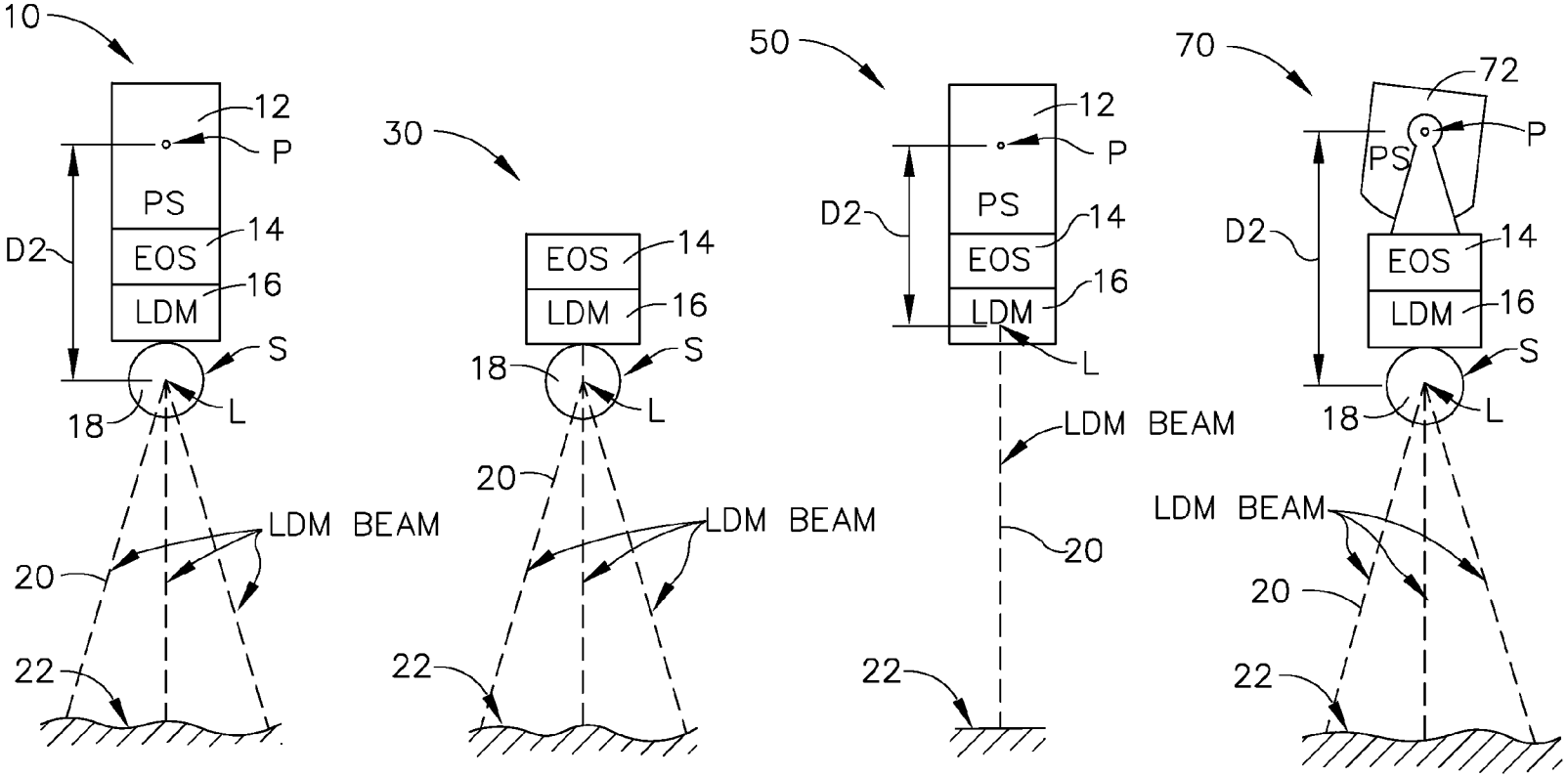
FIG. 1 is a diagrammatic view of an integrated sensing device of a first embodiment constructed according to the principles of the technology disclosed herein, having a position sensor (PS), an orientation sensor (EOS), an electronic distance measuring sensor (LDM), and a steering mechanism (S) that guides the LDM, for use on an earthmoving machine.
FIG. 2 is a diagrammatic view of an integrated sensing device of a second embodiment constructed according to the principles of the technology disclosed herein, having an orientation sensor (EOS), an electronic distance measuring sensor (LDM), and a steering mechanism (S) that guides the LDM, for use on an earthmoving machine.
FIG. 3 is a diagrammatic view of an integrated sensing device of a third embodiment constructed according to the principles of the technology disclosed herein, having a position sensor (PS), an orientation sensor (EOS), and an electronic distance measuring sensor (LDM), for use on an earthmoving machine.
FIG. 4 is a diagrammatic view of an integrated sensing device of a fourth embodiment constructed according to the principles of the technology disclosed herein, having a pivotable position sensor (PS), an orientation sensor (EOS), an electronic distance measuring sensor (LDM), a steering mechanism (S) that guides the LDM, and a pivoting base for the PS, for use on an earthmoving machine.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The terms "first" and "second" preceding an element name, e.g., first inlet, second inlet, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

In addition, it should be understood that embodiments disclosed herein include both hardware and electronic components or modules that, for purposes of discussion, may be illustrated and described as if the majority of the components were implemented solely in hardware.

However, one of ordinary skill in the art, and based on a reading of this detailed description, would recognize that, in at least one embodiment, the electronic based aspects of the technology disclosed herein may be implemented in software. As such, it should be noted that a plurality of hardware and software-based devices, as well as a plurality of different structural components may be utilized to implement the technology disclosed herein. Furthermore, if software is utilized, then the processing circuit that executes such software can be of a general purpose computer, while fulfilling all the functions that otherwise might be executed by a special purpose computer that could be designed for specifically implementing this technology.

It will be understood that the term "circuit" as used herein can represent an actual electronic circuit, such as an integrated circuit chip (or a portion thereof), or it can represent a function that is performed by a processing device, such as a microprocessor or an ASIC that includes a logic state machine or another form of processing element (including a sequential processing device). A specific type of circuit could be an analog circuit or a digital circuit of some type, although such a circuit possibly could be implemented in software by a logic state machine or a sequential processor. In other words, if a processing circuit is used to perform a desired function used in the technology disclosed herein (such as a demodulation function), then there might not be a specific "circuit" that could be called a "demodulation circuit;" however, there would be a demodulation "function" that is performed by the software. All of these possibilities are contemplated by the inventors, and are within the principles of the technology when discussing a "circuit."

Figure 5:
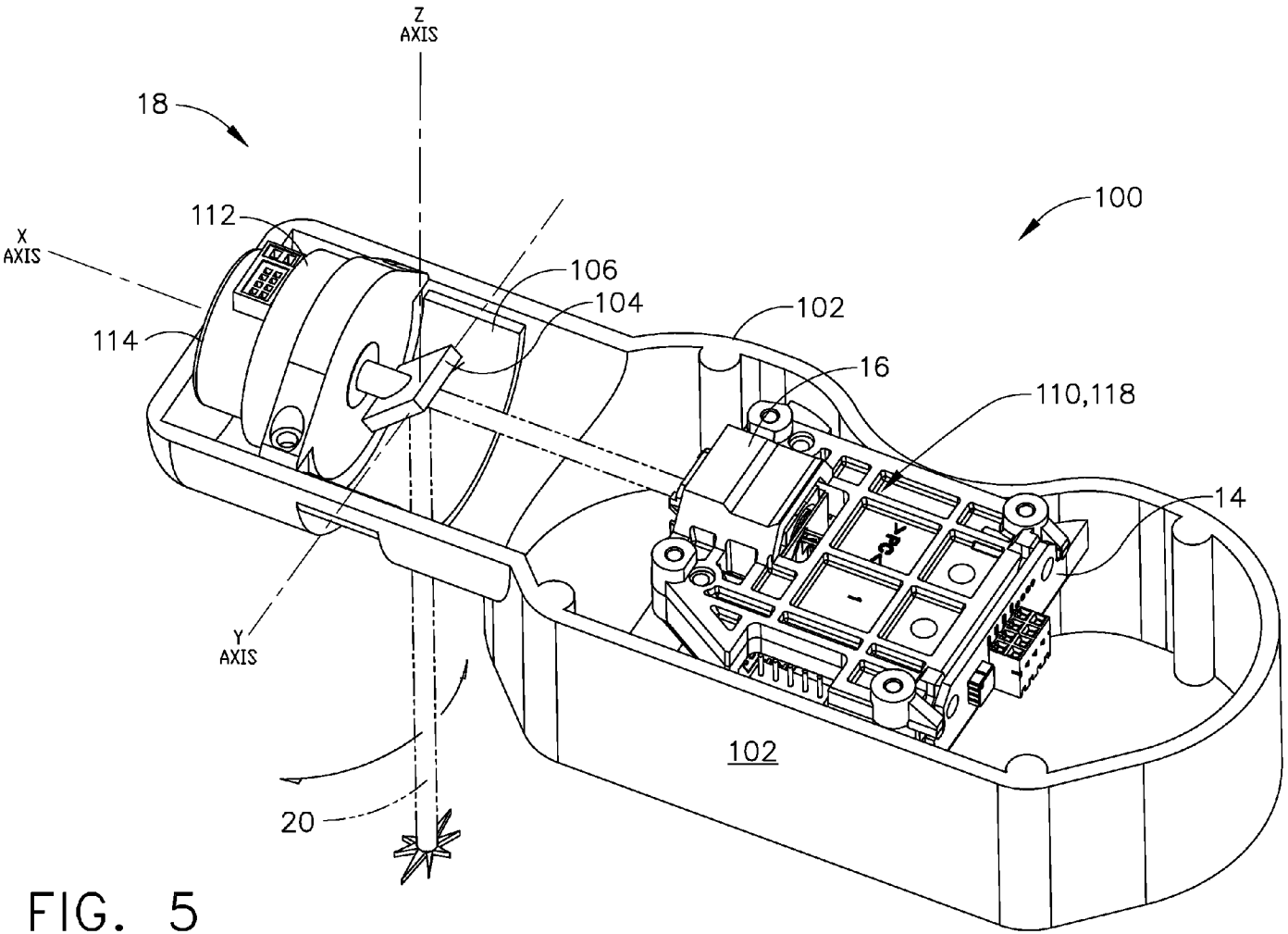
FIG. 5 is a perspective view of the electronic circuit portion of the integrated sensing device of FIG. 1, showing some of the important internal electronic components.
Figure 6:
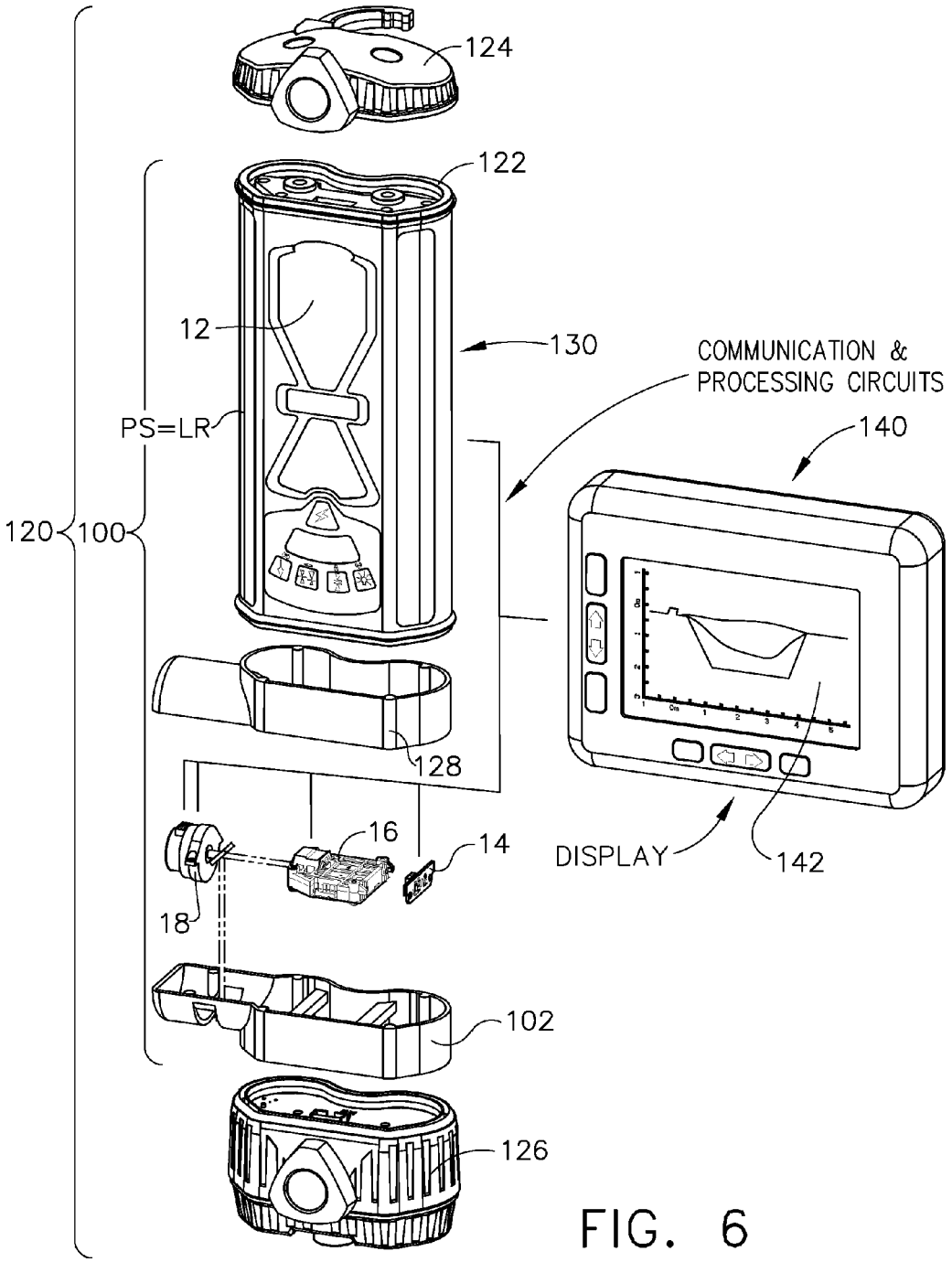
FIG. 6 is an exploded view of the integrated sensing device of FIG. 1, also showing a display monitor for use in the cab of the earthmoving machine.

In the technology disclosed herein, an electronically-controlled apparatus or sensing device, generally designated by the reference numeral 100 on FIGS. 5 and 6, is provided that typically includes a laser distance meter ("LDM") 16 which measures from the sensing device to points of interest, a steering mechanism ("S") 18 which moves the LDM sensing output beam and measures its orientation, an electronic orientation sensor ("EOS") 14 which measures the orientation of the sensing device 100, and a position sensing sensor ("PS") 12 which measures the position of the sensing device relative to a worksite datum, also known as a "benchmark" ("BM"). The sensing device 100 is mounted about the working tool of an earth working machine, such as an excavator or a bulldozer. It should be noted that, as options, some of the above equipment is not used in all embodiments; for example, the steering mechanism (S) is not used in every embodiment, nor is the position sensor (PS).

The sensing device 100 measures, and communicates to the user via a display monitor, the position of points of interest with respect to the worksite datum. The LDM of this sensing device can be steered about the area being worked to provide the location of many points of interest. These points can be numerically represented or plotted on the display monitor, forming profiles that are referenced to a worksite datum of the initial, latest, or desired terrain about the machine's working tool.

In the case of a bulldozer, the "working tool" typically is the cutting (bottom) edge of its blade; in the case of an excavator, the working tool typically is the bottom edge of the bucket, where the teeth are located. Other types of machines could have other types of working tools, such as a roller.

A "basic system" of the technology disclosed herein requires two components to be installed on the machine, which compares favorably to the typical five components that must be installed in the conventional systems known in the prior art. The first component is the main sensing device itself (i.e., the sensing device 100), and the second component is a display monitor that is mounted at the cab of the machine, where the machine's operator can easily view that display monitor. This basic system will act as a visible guidance system for use by an operator of earthmoving machinery.

The "basic system" does not require that its sensors be calibrated to machine members, whereas it is typical in the conventional (prior art) systems that the sensors must be calibrated to the machine members. The "basic system" also does not require that the geometry of machine members be measured and entered into the system, whereas again it is typical in the conventional (prior art) systems that this machine member geometry be accounted for. In other words, no "machine calibration" is required when using the "basic system" with an earthmoving machine.

When used with an excavator, the "basic system" further does not place any components on or near the bucket, which is a very destructive environment, and which is typical in the conventional (prior art) systems. All of the above make this "basic system" faster and easier to: (a) install, (b) start using, and (c) move to different machines, as compared to conventional (prior art) systems. The "basic system" moreover can make non-contact measurements, thereby avoiding disturbance or damage to points of interest, such as laid pipes, surveyor's stakes, or other existing materials. (Note that, as used herein, the term "basic system" includes the first four embodiments that are discussed below.)

Referring now to the drawings, FIGS. 1-4 show hardware block diagrams of some of the possible configurations of the sensing device 100. In these first four views, the sensing device is designated by four different reference numerals, 10, 30, 50, and 70, to indicated four different configurations of sensors. In all four cases, there is some type of electronic distance measuring device 16, generally referred to as an "LDM," and there is some type of electronic orientation sensor 14, generally referred to as an "EOS." More than one type of electronic device can serve as these sensors, but as discussed herein, the electronic distance measuring device 16 will typically be called a "laser distance meter" and the electronic orientation sensor 14 will typically be considered as a gravity sensing device. But it will be understood that these nomenclatures are typical only, especially for the EOS 14, which could perhaps measure other linear accelerations or angular accelerations, or could perhaps measure magnetic fields, for example.

In FIGS. 1-4, the sensing apparatus or device 100 may contain the following: (1) at least one laser distance meter 16 (LDM) that generates an output signal which represents the distance from a known point "L" on the apparatus 100 to the terrain surface, or to other points of interest being illuminated by the LDM sensing output laser beam; (2) an optional steering mechanism 18 (S) that allows the LDM sensing output beam 20 to be moved over a surface 22, or to points of interest; (3) an electronic orientation sensor 14 (EOS) that outputs the orientation of the sensing device 10 about the X, Y, and Z axes; (4) an optional position sensor 12 (PS) of a position sensing system, which outputs the position of the sensor's datum "P" relative to the position system's datum; and (5) a communication and processing circuit that combines the outputs of the LDM, EOS, S, PS sensors, and controls inputs to the steering mechanism S to scan, calculate and display the position of the point(s) of interest with respect to a worksite datum.

As can be easily seen in FIGS. 1-4, the steering mechanism 18 is not included in the third embodiment 50 of the sensing device (see FIG. 3), but it is included in the other three embodiments 10, 30, and 70. The position sensor 12 is not included in the second embodiment 30 of the sensing device (see FIG. 2), but it is included in the other three embodiments 10, 50, and 70. The fourth embodiment 70 includes a GNSS (satellite) antenna alignment member 72 that is not found in the other three embodiments 10, 30, and 50—see the discussion below. The first embodiment 10 is probably the most useful of all these systems, from a performance and cost-effectiveness standpoint, and its uses will be discussed below in much detail.

Before introducing the individual embodiments, the sensors will be discussed in some detail. With respect to the LDM 16, the LDM measurements are generally based directly or indirectly on the laser energy time of flight, not on image recognition. Image recognition could be utilized, if desired to achieve certain special functions, but such special functions are generally not required to effectively utilize this guidance system. It will be understood that the electronic distance sensor will typically be a device that does not make physical contact with the jobsite surface. As noted above, the electronic distance sensor for this technology will typically be selected as a laser distance meter, and certainly the laser light beams (the photons themselves) will make contact with the jobsite surface; however, that type of photon "contact" is not within the definition of "physical contact," as used herein.

With respect to the steering mechanism 18 ("S"), a motorized mirror system can be used that steers the LDM sensing output beam about one or more axes. For example, a one-axis or two-axis galvanometer could be used. A mechanism S for scanning about one axis (e.g., the X axis) is illustrated in FIG. 5. The steering motion could be a back and forth motion or a continually rotating motion. Instead of using a mirror (as a reflecting device), the mechanism S could alternately use a prism or lens (a refraction device) to steer the LDM sensing output beam. In one embodiment, the LDM sensing output beam movement in each axis is measured by an encoder with respect to the device null reference ("n"). In alternative embodiments of "S", the encoder could be eliminated if no PS sensor is used, or the distance from LDM to PS datums (distance "D2" on FIG. 1) is small and uncompensated tilting of that small distance causes insignificant error. In these alternative embodiments, the EOS is also used is to provide the orientation of the LDM sensing output beam. In one such alternative embodiment, the EOS (and its mirror) is mounted to the motor shaft. In another such alternative embodiment, the LDM and EOS are mounted to the motor shaft (and there is no mirror).

It will be understood that the term "datum" refers to a point in space, having three dimensional (3-D) spatial coordinates on a worksite that itself can be defined in three dimensional space. When the term datum is used in conjunction with a sensor, such as in the phrase "sensor output datum," then it refers to a specific spatial point with respect to an important attribute of such a sensor. For example, a GPS (or GNSS) receiver will have an antenna, and the datum of that antenna (point "P" in FIGS. 1, 3, 4) is the spatial point on the antenna where (in global coordinates) the current position of the antenna is determined, with respect to the GNSS signals. And for example, a laser distance meter (LDM) will generate a laser light output signal, and will receive back a portion of that laser light output signal; the datum for that LDM (point "L" in FIGS. 1-4) is the point on the LDM package itself where the actual distance measurement is being made by that LDM device, and that datum point will also have a 3-D spatial coordinate with respect to a jobsite's 3-D coordinate system, after the systems have been aligned.

With respect to the electronic orientation sensor 14 ("EOS"), it is a sensor that outputs a signal representing the orientation of the sensing device. In FIG. 5, the illustrated embodiment includes a electronic circuit providing orientation information about the X, Y, and Z axis. The EOS contains accelerometers in one or more axes, and can optionally contain gyroscopes in one or more axes. Furthermore, the EOS may optionally include vector magnetometers (electronic compasses) in one or more axes. Note that micromachined integrated circuit chips are commonly used as tiny accelerometers, gyroscopes and tiny magnetometers, in today's technology. Many available products include accelerometers, gyroscopes, and magnetometers in a single package. For example, X-, Y-, and Z-axis accelerometers and gyros (as per FIG. 5) could be configured to determine the sensing device's inclination from its null reference (n) with respect to gravity for each axis. The gyro(s) could be used to improve the dynamic performance of the accelerometers seeking the gravity reference and also to help resolve the accelerations sensed into angular and linear components. The magnetometers and gyros could be configured to determine the sensing device rotation (heading) about the Z-axis with respect to magnetic north, for example. The gyro(s) again could be used to improve the magnetometer's dynamic performance.

With respect to the position sensor 12 "PS," there are several possible types of sensors that could perform this function. Examples of position sensors and their related systems are: (a) a laser receiver ("LR") of a laser plane system which outputs the position of a laser strike on a photocell array relative to a datum "P" on the receiver; (b) an antenna (and receiver) of a global navigation satellite system ("GNSS") optionally with differential correction and real time kinematic capabilities, which outputs the position of the antenna centroid located at datum "P", herein referred to as a GNSS receiver; (c) a target array of a robotic or tracking total station system ("TTS," which is a construction industry sensing device that is well known to those skilled in this field of technology), which is in communication with the total station and outputs the position of the target array centroid located at datum "P", herein referred to as a TTS target; and (d) a GNSS receiver and system that is augmented with a LR receiver and system. (The GNSS receiver provides two-dimensional position in the X- and Y-axes (in the plane parallel to the horizon), while the LR provides the third dimension position in the Z-axis (vertical).

FIG. 5 partially shows one preferred embodiment for the packaging of a sensing device 100, which includes a PS 12 (not shown), an EOS 14, an LDM 16, and a steering mechanism 18 (S), and an electronic circuit board 110 that acts as the sensing device's system controller. Sensing device 100 has an intermediate housing 102 that holds the electronics in place, as well as the steering mechanism 18. The steering mechanism (S) includes a rotating mirror 104, and window 106 in the side of the housing, an electric motor 112 that spins a shaft which rotates the mirror, and an encoder 114 to track the position of the mirror/motor subsystem.

FIG. 6 is a drawing of a more complete package for the device 100, and the overall package is generally designated by the reference numeral 120. The position sensor is a laser receiver 122 covered by the overall outer housing, with windows transparent to the laser energy at 130, while a top portion is at 124, a bottom portion is at 126, and two intermediate housings are at 102 and 128. In this embodiment, the position sensor may include some local display status indicators. This makes up the first component described above, while the second component is a remote display monitor 140. A preferred remote display monitor comprises a flat panel display, with a visible display area at 142.

The communication and processing circuit 110 (see FIG. 5) combines the outputs of the LDM 16, EOS 14, S 18, and PS 12, and provides inputs to the steering mechanism 18 to scan, calculate and display the position of the point(s) of interest with respect to a worksite datum. The communication circuit between the first and second components 120 and 140 could be wired or wireless. The processing circuit could be in a single component microcontroller or microprocessor, or it could be comprised of a distributed processing system if desired. There will also be at least one memory circuit 118 to store and process the sensing device setup parameters, the working input data as it is gathered by the sensors, and to store the desired display parameters.

The sensing device 100 may be assembled and calibrated in a precise and controlled factory environment by trained technicians overcoming many of the field installation and machine calibration problems of conventional systems. In the "basic system" illustrated in FIGS. 1-4, for example: (a) the LDM sensing output beam would be pointed to align with the sensing device null axis "n" and the distance reading of the LDM would be nulled at the LDM Datum ("L"). In this instance, the term "L datum" specifically refers to a point in space, as indicated on the drawing (see FIG. 1, for example); (b) the inclinometers of the EOS would be aligned to output the angles between the sensing device null axis "n" and gravity "g"; (c) the encoder of the steering mechanism in each steering axis would be aligned to output the angle between the LDM sensing output beam and the sensing device null axis "n", should the LDM be steered away from the device null axis "n"; and (d) the distance between the P datum and the L datum (which schematically create a line "D2") would be measured and stored in sensing device memory at the factory. In this instance, the term "P datum" specifically refers to a point in space, as indicated on the drawing (see FIG. 4, for example). It should be noted that the calibration parameters of the sensing device are not dependent on the geometry of the earthmoving machine.

It should also be noted that the encoder output signal of the steering mechanism is aligned to the device null axis (n), and it is not referenced to any component of the earthmoving machine that the sensing device will be mounted to. The EOS includes a gravity sensor that can measure (and, therefore, effectively find) the true vertical with respect to the Earth's gravity. With this sensing capability, the device null axis (n) is referenced to true vertical. Therefore, the EOS is not referenced to any component of the earthmoving machine that the sensing device will be mounted to. In sum, the outputs of the sensors of sensing device 100 are not related to, nor dependent on, any particular physical position or alignment with respect to the earthmoving machine that sensing device 100 will be mounted to.

First Embodiment

Figure 7:
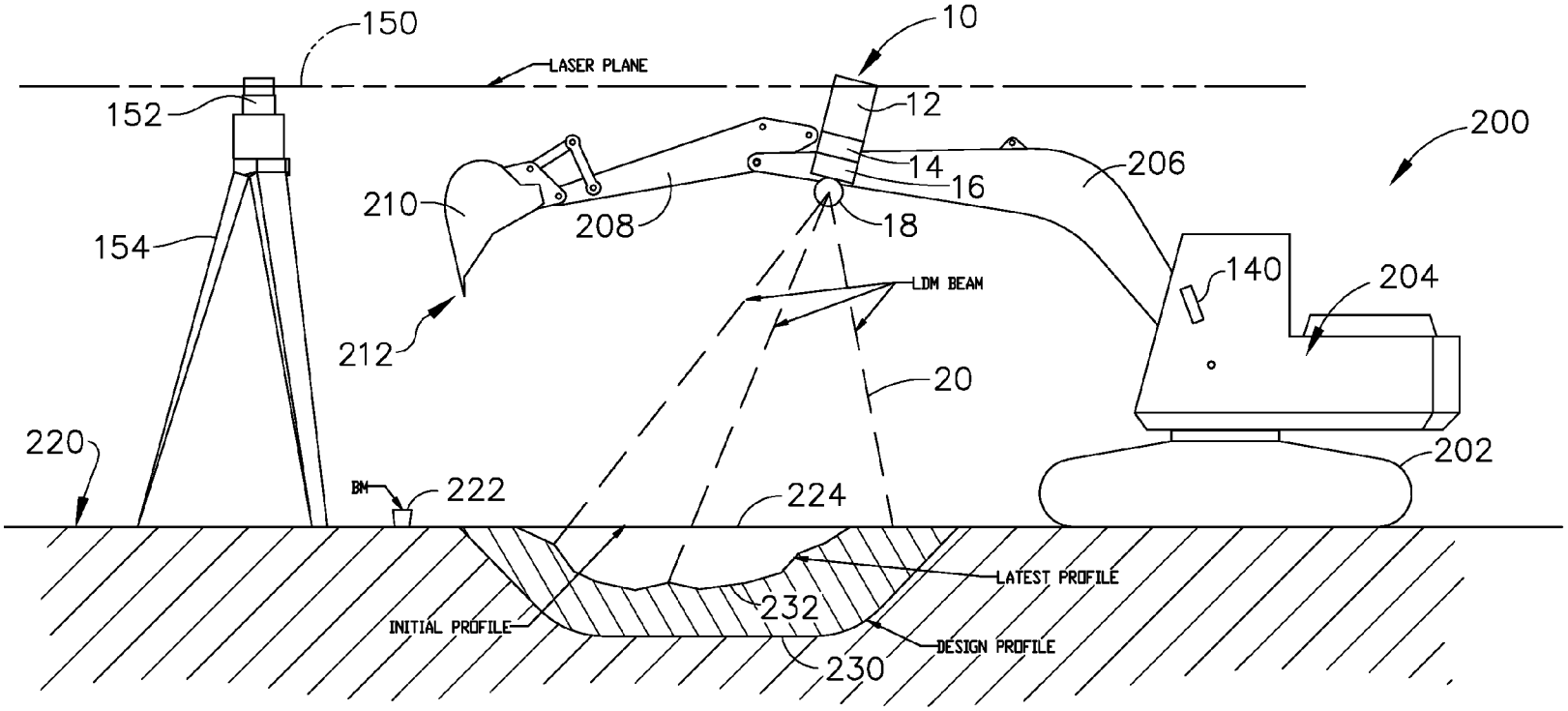
FIG. 7 is a diagrammatic view, depicted as a side elevational view, of an excavator earthmoving machine that has the integrated sensing device of FIG. 1 mounted to its boom, showing the "dig site" being scanned by the LDM.

Referring now to FIG. 7, the sensing device configuration is that of reference numeral 10 on FIG. 1, in which the PS (position sensor) 12 is a laser receiver (or "LR"). LR 12 is mounted to the boom 206 of an excavator 200, in this basic system embodiment. The excavator 200 includes a "platform" 204, the boom 206, a dipperstick (or merely "stick") 208, and a bucket 210, which is the working tool of this system. The bucket 210 has a digging edge 212 at the distal end of the bucket, and in most excavators, this digging (or cutting) edge has teeth (see FIG. 18 as an example). The platform rests on a set of linked tracks 202 (similar to tank treads), which allow the entire machine 200 to move about the jobsite. There is a display monitor 140 in the cab of the excavator, mounted at a position where the machine operator can easily see it while operating the machine 200.

In FIG. 7, there is a laser transmitter 152 that emits a plane of laser light at 150. Laser transmitter 152 can emit a rotating laser beam, or a static fan beam, depending on the laser receiver technology used. The laser transmitter is mounted on a tripod 154, which rests on the ground surface 220 in this example. The surface 220 is essentially flat and level in FIG. 7, but that is not a necessary condition for the use of this basic system. The excavator 200 is being used to dig a trench or ditch, which has a design profile at 230, and is the "target" of what the operator is trying to accomplish. The initial profile is indicated at 224 (and is essentially co-linear with the ground surface 220 in this example), and the "latest profile" at 232 is the current surface shape, after the most recent digging maneuver has been performed by the excavator.

Figure 8:
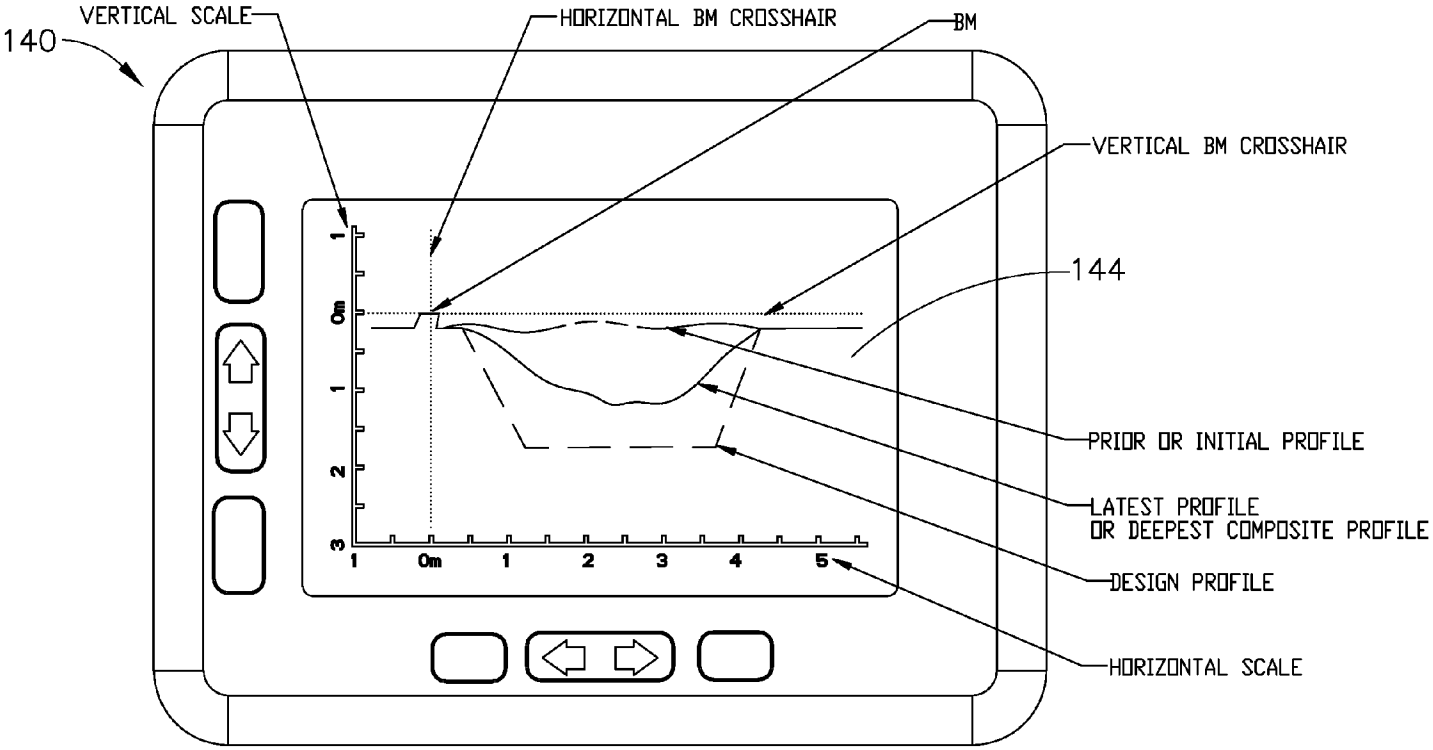
FIG. 8 is a diagrammatic "screen shot" view of an example display that is presented on a display monitor, used as part of the integrated sensing device of FIG. 7, showing a BM centric view.

The sensing device 10 includes a steering mechanism 18, so the LDM 16 can be directed at multiple angles, as indicated by the plurality of LDM "beam lines" 20 on FIG. 7. This allows the sensing device to detect the true profile of the dig site, before, during, and after the digging operation. Therefore, the display monitor 140 can provide the machine operator with the actual "latest profile" 232 on the display surface 144—see FIG. 8, for example. Assuming the dig site has a benchmark (the "BM" at 222), and the machine operator has "found" that benchmark before starting the dig (and has entered that information into the sensing device memory), then the display surface 144 will indicate that BM position in relation to the profiles that will be displayed during the dig. In the example of FIG. 8, the distance scales (i.e., the Y-axis and Z-axis) can be referenced to that BM position on the ground. It will be understood that this example is only a two-dimensional example, for sake of clarity; the system could also work in the third dimension, if desired. Many dig profiles will require 3-D treatment.

Figure 21:
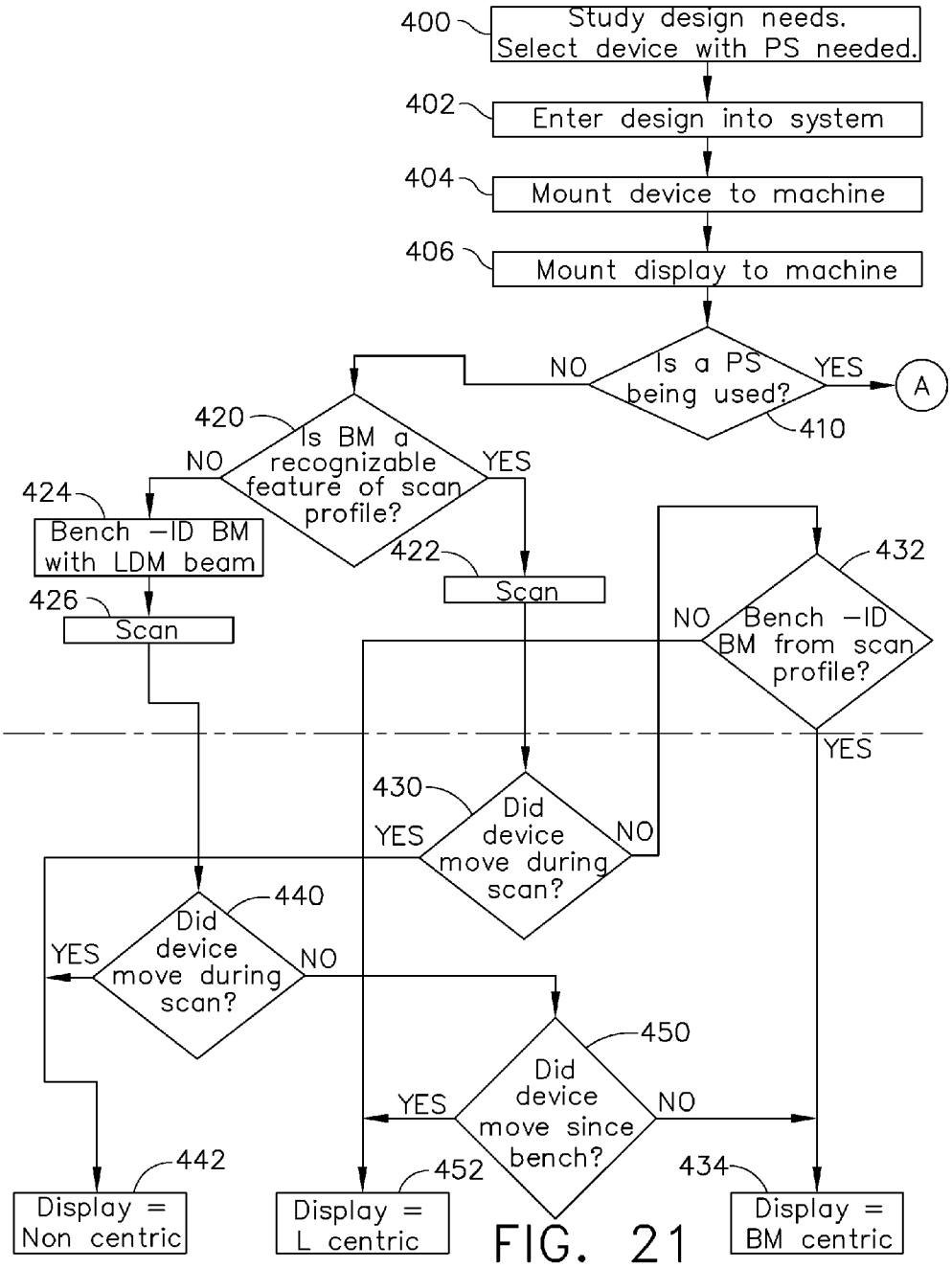
FIG. 21 is a flow chart of some of the important steps performed by a user and a system controller used in the instant technology, in which the integrated sensing device has no position sensor.
Figure 22:
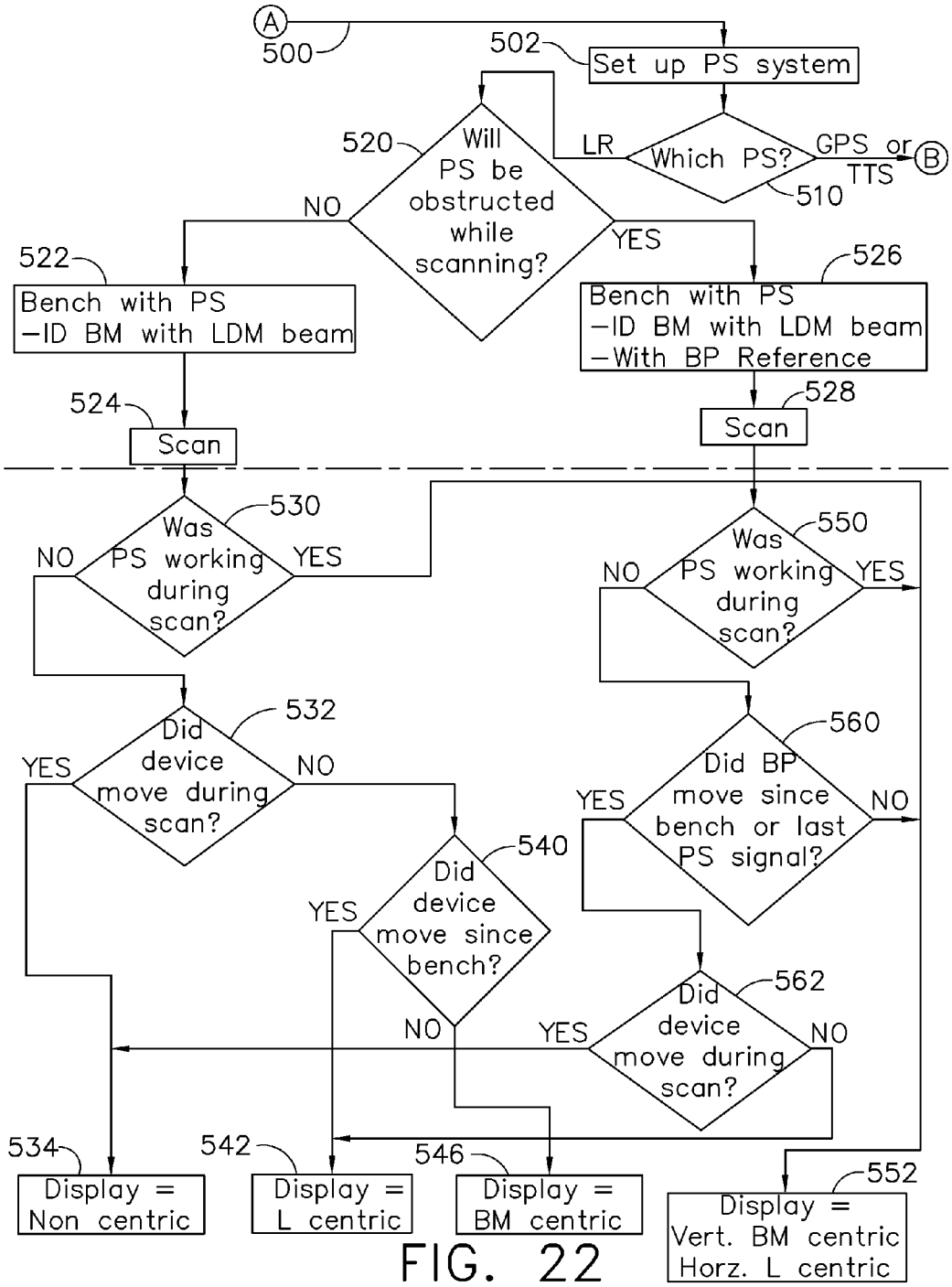
FIG. 22 is a flow chart of some of the important steps performed by a user and a system controller used in the instant technology, in which the integrated sensing device has a laser receiver as its position sensor.
Figure 23:
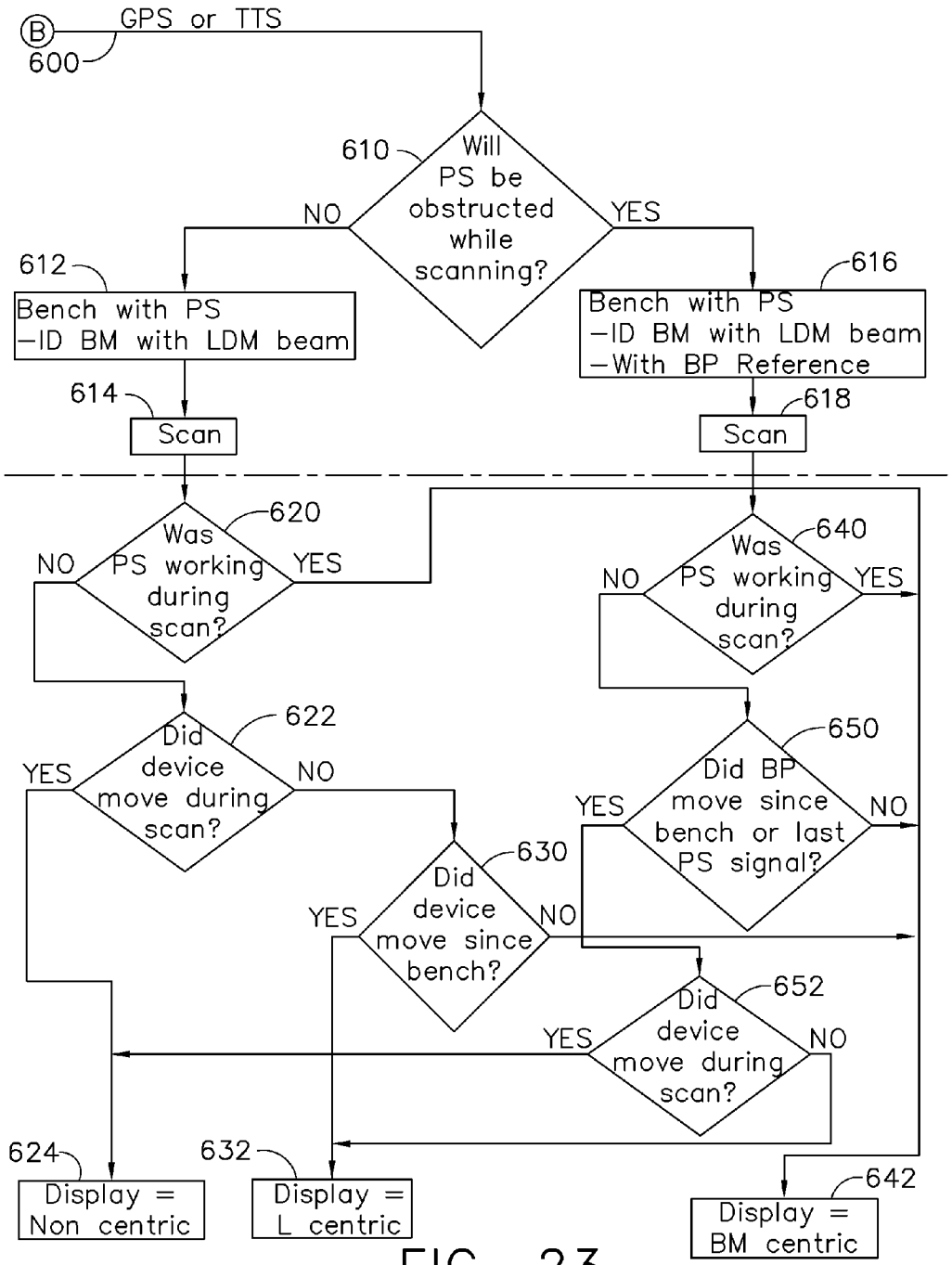
FIG. 23 is a flow chart of some of the important steps performed by a user and a system controller used in the instant technology, in which the integrated sensing device has a GNSS receiver or TTS target as its position sensor.

A summary of some of the important operational steps is now provided; note that the flow charts of FIGS. 21-23 also disclose some of the logic that is involved. One important step is to study the excavation design needs and select the sensing device configuration that best meets those needs; for example, will the PS be a laser receiver, or a GPS receiver, or some other type of position sensor? The "design profile" is the desired final profile of the excavation. It could be entered into sensing device memory and displayed when the BM is identified (as seen in FIG. 8). It could be generated by:

(a) Entering points manually via the user interface of the display monitor 140. This could be as simple as a horizontal plane that is vertically offset from the worksite BM;

(b) Use of an electronic worksite design 3D contour file. In this mode, the system determines the design profile from the intersection of the worksite design contour features and the scanning plane. The scanning plane's orientation to the worksite horizontal plane (heading) is given by the electronic compass of the EOS 14; or (c) Scanning an existing terrain profile and fitting a design to that information.

The sensing device 10 is mounted with consideration for LR laser plane reception and location of the desired LDM scanning pattern. The sensing device mounting could be magnetic such as a "MM2 Mag. Mount" sold by Trimble Navigation Limited. The display is also mounted in the cab with consideration for user viewing and access. Note: in this description, the term "user" is the same person as the "operator" of the machine 200.

The laser transmitter is set up to create a plane of laser energy that is oriented as desired to the worksite. For example, the laser plane is created at the laser transmitter by rotating a laser beam about a vertical axis.

Two methods of benching the system to the worksite benchmark are now described below. (Note that the term "benching" is the alignment of the position sensor system and sensing device output coordinates to the worksite coordinate system, for this first embodiment, and others).

(a) Option 1: Identify the BM with the LDM sensing output beam.

The LDM sensing output beam 20 is steered to illuminate the worksite benchmark 222 (BM). While illuminating the BM, the user initiates the bench function on the display interface, where the user controls a pointing device. A small amount of efficient and diffusive reflective material may be added to the BM to help the user visually verify when the BM is illuminated by the LDM sensing output beam (for example, a disc of glass bead reflective tape). A target of unique geometric and or reflective properties could be added to the BM to allow the system via a LDM scanning routine to quickly and accurately (automatically) find the BM with less effort from the operator.

(b) Option 2: Identify the BM relative to a displayed scan profile.

The user initiates a scan of the work area and identifies the BM 222 from the scan profile presented on the display monitor 140. If the BM is a small feature, the user or a scan routine may steer the LDM beam to dither about the general area of the BM until the BM geometry is apparent on the displayed latest profile. The user aligns the horizontal and vertical BM crosshairs relative to a feature visibly recognizable on the profile displayed. If the BM coordinates are not (0, 0, 0), the user may enter the correct BM coordinates values into the system. The advantage of this benching method is that the user does not have to visually verify that the LDM beam is illuminating the BM. Visually verifying LDM beam illumination of the BM can become difficult with distance, viewing angle, BM material, and lighting conditions.

After the BM has been identified and entered into the sensing device memory, the system is ready for use displaying the location of scanned points of interest to the user. NOTE: no calibration of the sensing device sensors to the machine, or measuring of machine geometry was required, to achieve this status.

As noted above, the operator cab includes a display monitor 140 (see FIG. 6), which provides many features, including the following: (a) the monitor can display a plot of the scanned points (profiles) or selected points (see FIG. 8 for an example); (b) the monitor can display the coordinates of points relative to BM or other defined reference points; (c) on the monitor, different types of profiles (previous, latest, deepest, design, etc.) are distinguished by line color, weight, type etc.; (d) profiles can auto scale and auto center on the display monitor; (e) the user can drag BM cross hairs to identify BM on monitor screen. The machine operator would use some type of electronic pointing device to move a cursor, such as a joystick, or if using a touchscreen display, could directly move the pointer by direct touch of a finger on the display panel; (f) the monitor also serves as user interface; (g) the monitor can pan and zoom the displayed profiles. In other words, the machine operator, while viewing a profile, could enlarge a certain portion of the image, or the operator could translate the display in the Y- or Z-axis, if desired; (h) references (sensors, etc.) available to the system may determine display modes, as described below.

Types of Display Modes

The sensing device is capable of being used in alternative modes, particularly concerning the types of information that is being displayed to the machine operator. In general, the "best" display mode is always provided. The particular display mode provided depends on the presence of the position sensor and whether it is producing an output. An example of when a position sensor stops providing a usable output signal is when a laser receiver is moved out of the laser plane, or when a GNSS receiver has its satellite signal obstructed. The type of display mode also depends on the type of position sensor, whether it has been benched to jobsite coordinates, and movement of the sensing device after benching. The various display modes, and their operating conditions, are discussed below.

(A) "BM centric" Display. (Used when a worksite BM is available; see FIG. 8, for example.)

(1) Profiles and points of interest are displayed relative to the worksite BM.

(2) BM location is emphasized with cross hairs and scales nulled at the BM.

(3) Design features or profiles related to BM are displayed.

Figure 9:
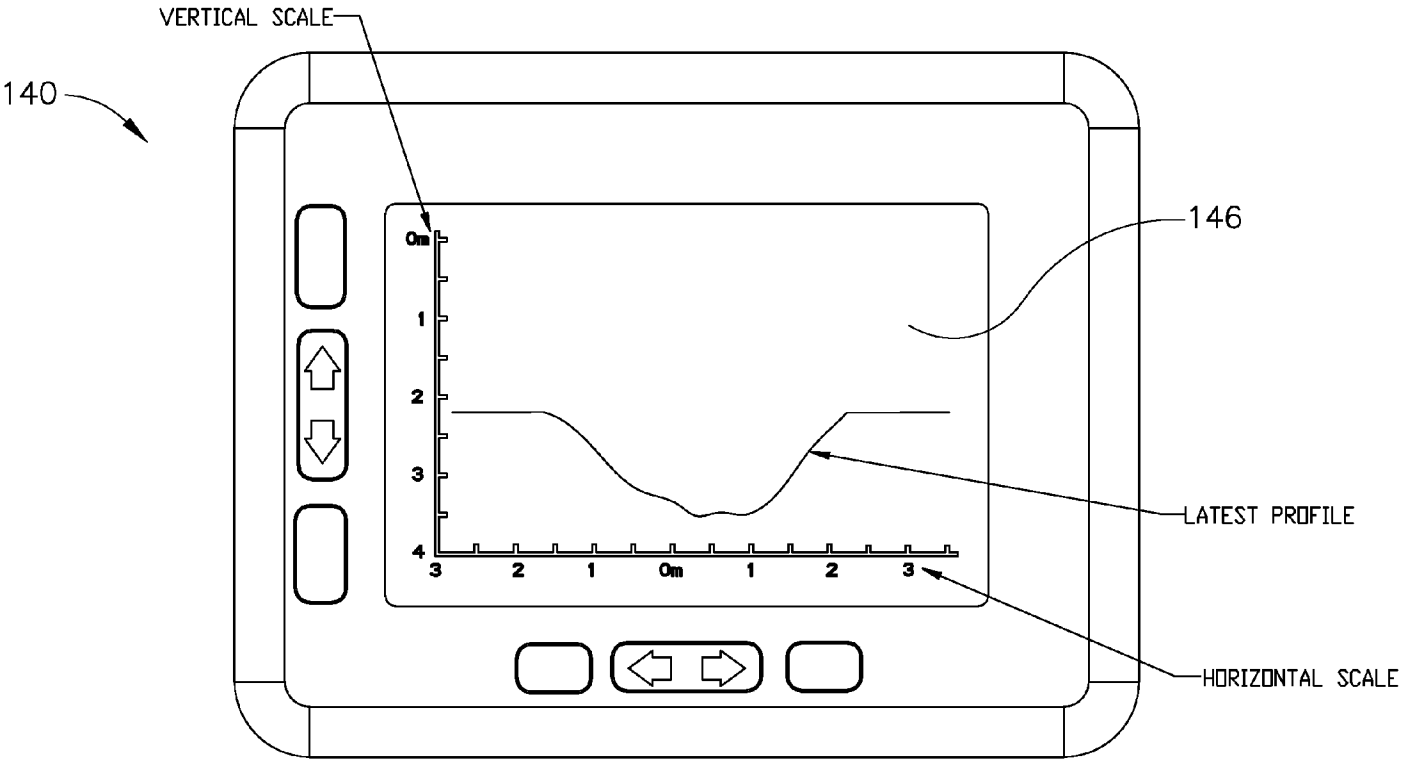
FIG. 9 is a diagrammatic "screen shot" view of an example display that is presented on a display monitor, used as part of the integrated sensing device of FIG. 7, showing an L centric view.

(B) "L centric" Display. (The sensing device is static during scan, but a BM is not available; see FIG. 9, for example.)

(1) Profiles and points of interest are displayed relative to the LDM datum L.

(2) No BM, BM cross hairs, or BM related design features are displayed. There would be no virtual benchmark available for the user, in this operating mode. (On FIG. 9, the display screen 146 shows no benchmark)

(3) The graphical scales are nulled at L.

(C) "Vertical BM centric and Horizontal L centric" Display. (Used for laser receiver as the PS and a nominally horizontal laser plane.)

(1) The LR can only reference any BM, vertically.

(2) Vertical display features are BM centric.

(3) Horizontal display features are L centric.

Note: in the "Vertical BM centric and Horizontal L centric" display mode, only the elevation is known. However, this mode still can be useful if the machine has been moved after its initial benchmarking occurred, at this site. Once the laser plane has again been "found" by the laser receiver LR (as the position sensor 12), this mode can allow the machine to continue work in a limited capacity, without re-benchmarking.

(D) "Non centric" Display. (The sensing device is moving during scan, and no PS reference is available.)

(1) On the monitor, the profile can be plotted using V3*i* and H3*i*, but no scales are displayed. (See below description of these variables V3*i* and H3*i*.)

(2) Movements are determined by the EOS 14.

Scanning Options

In this portion of the detailed description, the term "scan" refers to using the LDM 16 with its steering mechanism 18 to accumulate samples of distances between the LDM and the target(s) of interest. Those distance samples will be stored in the sensing device memory 118, for use by the user/operator, as per the display mode and "digging mode" desired by that user. A single scan can be performed over a target area of interest, or multiple scans can be made over the target area, with the results then filtered.

(A) Scans can be initiated manually or automatically as selected by the user.

(1) Automatic scans could be triggered by conditions, such as:

(a) Each time the LR passes through the laser plane.

(b) When the PS and/or EOS outputs are within a selected range.

(c) When functions of the EOS outputs are in a selected range (e.g., velocity, acceleration).

(d) When the magnetic compass of the EOS is within a selected range (e.g., to ensure the sensing device is aligned with a trench before scanning)

(e) When there has been an LDM distance discontinuity as the bucket passes under it. The sensing device could then track behind this discontinuity, essentially tracking behind the bucket during a dig cycle to give the operator the most current excavated terrain profile.

(2) Any combination of the above can be used, indicating the working tool is in the desired scanning area of the worksite and/or in the desired position of a digging cycle.

(B) The scanning pattern parameters, such as the range and interval between points read, could be adjusted as desired.

(C) Scanning parameters affecting accuracy of point readings, such as the time spent reading each point, could be adjusted as desired.

(D) The scanning could be limited to a single point of interest, and the location of that point reported.

(E) The LDM sensing output beam could be manually steered to points of interest. The machine operator could use the electronic pointing device for this function (either a joystick or a touchpad, for example).

(F) Various scans could be saved and displayed (see FIG. 8), such as an initial scan of the work area, or the latest scan of the work area. Composites of saved scans could be constructed and displayed, such as the lowest elevation of multiple scans for a given work area. When used hereinafter the term "latest profile" may be the most recently scanned data, or it may be a composition of the most recent and any previously scanned data of interest to the user, such as an initial scan or the deepest portions of the previously scanned excavation. Moreover, it will be understood that the actual data being represented by the "latest profile" either could be two-dimensional or three-dimensional data, as desired by the user.

It will be understood that the processing needed for determining the "latest profile" could occur in the processing circuit 110 of the integrated sensing device 100, or it possibly could occur in a processing device that is associated with the remote monitor 140 (which is mounted in the cab of the earthmoving machine). Whichever processor is selected for performing these calculations, it needs to be supplied with data representative of the signals that are output by the LDM sensor 16 and the EOS 14.

The scanned points of interest or profiles can also be recorded by the system along with their location and heading on an electronic worksite plan (a virtual plan). This could later be compiled on an electronic worksite design to show progress of excavation.

Figure 10:
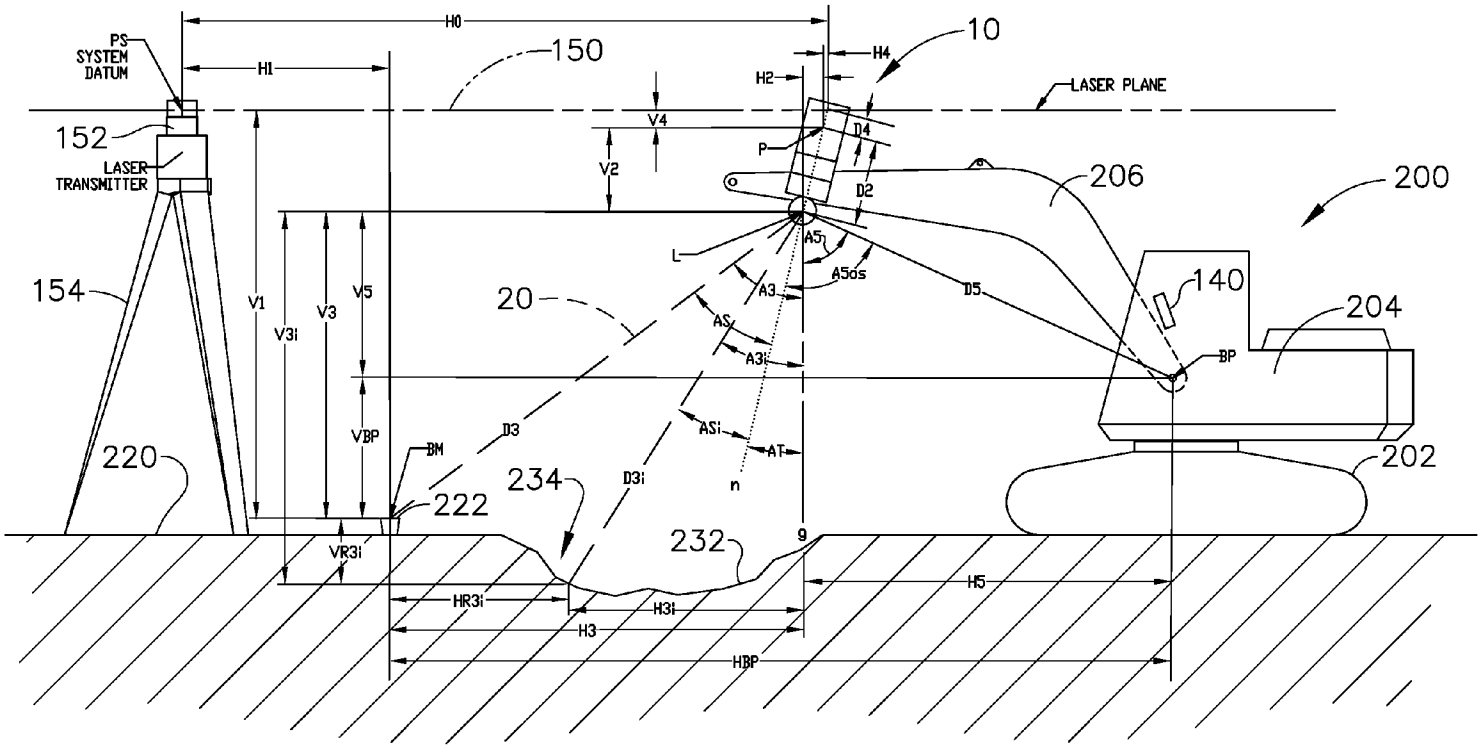
FIG. 10 is a diagrammatic view, depicted as a side elevational view, of an excavator earthmoving machine that has the integrated sensing device of FIG. 1 mounted to its boom, showing the "dig site" being scanned by the LDM, during a benching procedure.

Referring now to FIG. 10, a more detailed diagram of an excavator machine using the first embodiment sensing device 10 is depicted, in which the PS 12 is a laser receiver (LR), and during benching the LDM sensing output beam 20 measured distance is =D3. A point of interest, at 234, is scanned by the LDM sensing output beam 20, and the beam's measured distance is =D3*i*. When the system is benched, it aligns the coordinate systems of the worksite and position sensor of the sensing device 10.

For simplicity of the figures and equations in this disclosure, the sensing device's LDM scanning plane is shown as a vertical plane (i.e., the plane of the reader's page), and the worksite and position sensing system coordinates are shown aligned to the LDM scanning plane. As such, a laser plane system will be depicted as a 1D (one-dimensional) system (capable of guidance in the vertical direction), and the GNSS and TTS 3D systems will be depicted as 2D where the two horizontal axes' features are projected onto the LDM scanning plane. In practice the EOS's inclinometer(s) and magnetic compass(es) would indicate the orientation of the scanning plane to 3D design features, allowing the projection (or intersection) of those features onto the scanning plane and creating the design profile.

A design profile can be created using a 3-D jobsite design software program, and that design profile could then be introduced into the memory circuit 118 of the sensing device 100. Alternative, a 3-D virtual jobsite plan could be directly introduced into the memory circuit 118, and then the processing circuit 110, via a special computer program, could be used to generate a design profile for a particular portion of the jobsite surface that is covered by this virtual jobsite plan. Both of these methodologies are included in the terminology of "determining" a design profile for a predetermined digging operation.

Example

Bench-Identify the BM with the LDM Sensing Output Beam

When the LDM 16 is steered to illuminate the BM 222, the PS 12 is receiving its signal, and the user initiates the bench function. The system now determines the distances (V1 and H1) between the worksite BM 222 and the position sensing system datum at the laser transmitter 152. (See FIG. 10.) The following equations are applicable to the system diagram of FIG. 10:

$$V1=V0+V3+V2+V4=D3*\cos(A3)+(D2+D4)*\cos(AT) \quad \text{EQUATION 1:}$$

$$H1=H0-H3-H2-H4=D3*\sin(A3)+(D2+D4)*\sin(AT) \quad \text{EQUATION 2:}$$

(Note: For PS=LR, H1 is not determined)

Where:

$$A3=AS+AT \quad \text{EQUATION 3:}$$

$$A3i=ASi+AT \quad \text{EQUATION 4:}$$

AT=Angle output from EOS X axis inclinometer (i.e., the angle of device null axis "n" with respect to gravity).

AS=Angle output of X axis steering mechanism encoder while LDM illuminating BM (i.e., the angle between LDM sensor output beam and device null axis "n").

ASi=Angle output of X axis steering mechanism encoder while LDM illuminating a point of interest.

D3=LDM output distance from L to BM

D3*i*=LDM output distance from L to a point of interest.

D2=Distance from L to P datums.

D4=Distance from P datum to laser strike on photo detector array. For PS=GNSS or TTS, D4=0.

H0=Horizontal distance from position system datum to position sensor datum.

V0=Vertical distance from position system datum to position sensor datum. For LR, V0=0; V0 is not shown in the LR examples of FIG. 10 and after initial equation derivations.

After the system has been benched and while the PS 12 is receiving its signal, the vertical and horizontal distances (VR3*i* and HR3*i*) of any point of interest can be displayed BM centric, even while the sensing device is moving, as determined by:

$$VR3i=V0+V1-V4-V2-V3i=V1-(D4+D2)*\cos(AT)-D3i*\cos(A3i) \quad \text{EQUATION 5:}$$

$$HR3i=H0-H1-H2-H4-H3i=H0-H1-(D2+D4)*\sin(AT)-D3i*\sin(A3i) \quad \text{EQUATION 6:}$$

For PS=LR. Since the laser plane system only references the BM vertically, if the sensing device is moved after benching or during a scan (determined by the EOS), profiles of subsequent scans will be vertically BM centric, but horizontally L centric as determined by;

$$H3i=D3i*\sin(A3i) \quad \text{EQUATION 7:}$$

At times when the PS has no usable signal output, the system will (temporarily) operate in a manner as described below for the second embodiment. Alternately the sensing device 10 could be mounted to the platform, stick, bucket cylinder, or other suitable member of machine, as desired.

Alternatively, the sensing device may also perform a routine that scans the profile of the working tool while its cutting edge rests on a flat or other predetermined surface. The routine would then construct an image (cross section) of the tool from the scan profile(s), with the cutting edge determined by the flat surface. In later operation the system would recognize a portion of the tool profile and place an image of the tool (with cutting edge) on the display at that location and orientation. Not only can the tool image be displayed in its current orientation, but also the monitor could show the distance between the working tool edge and the desired elevation (the design profile at this horizontal position on the jobsite surface).

Alternatively, the PS 12 could be an antenna of a GNSS receiver, the Target of a TTS, or a GNSS receiver augmented with a LR. Alternatively again, if the PS 12 technology is GNSS, the sensing device configuration depicted in FIG. 4 could be used to keep GNSS antenna best aligned with the satellite constellation, and to avoid multipath effects. The antenna at 72 would be aimed generally upwards at the satellite constellation, and the pivot point could be coincident with the position sensor datum P. An example of such a configuration would be the GNSS antenna supported by a dampened pendulous arrangement.

Second Embodiment

Figure 11:
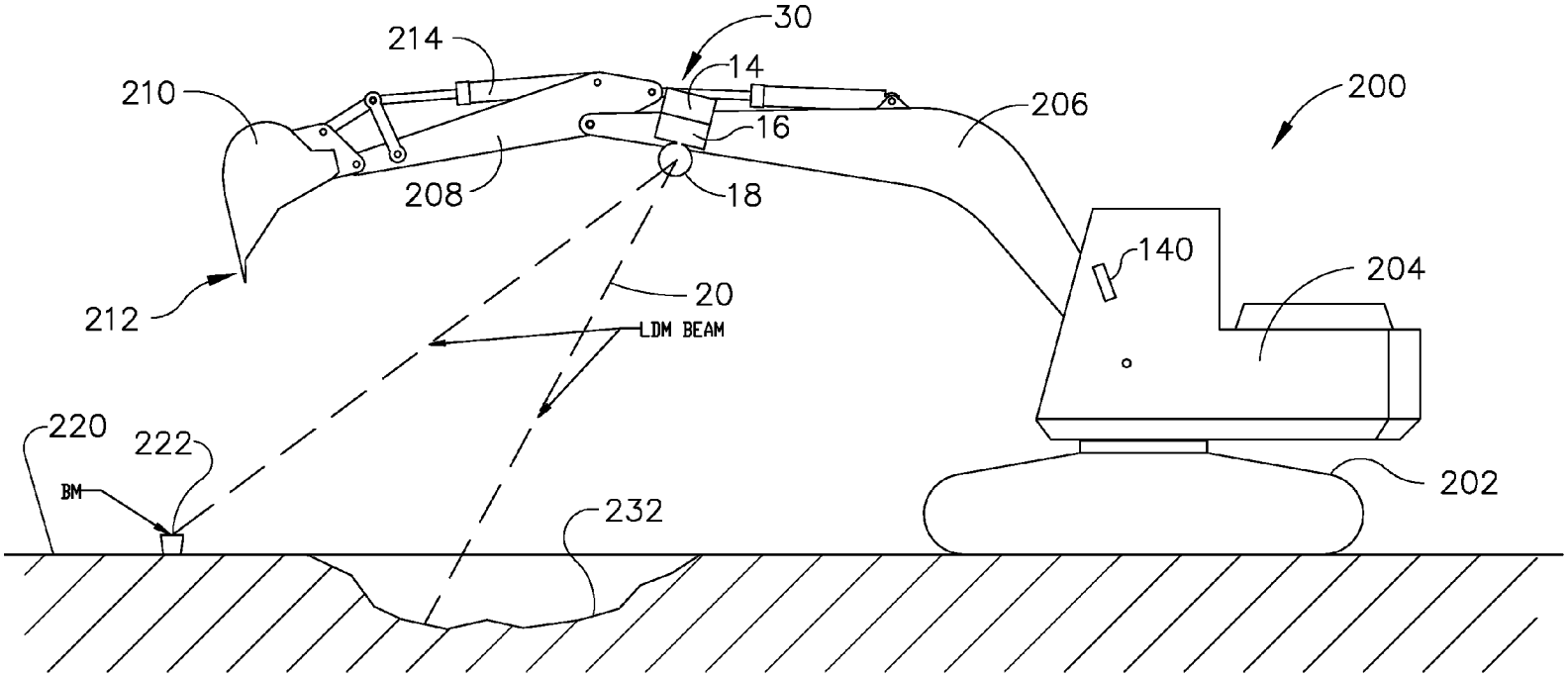
FIG. 11 is a diagrammatic view, depicted as a side elevational view, of an excavator earthmoving machine that has the integrated sensing device of FIG. 2 mounted to its boom, showing the "dig site" being scanned by the LDM, or during a benching procedure.

Referring now to FIG. 11, an excavator 200 is depicted with a sensing device 30, having the configuration of FIG. 2, mounted to the boom 206, in this second basic system embodiment. The second embodiment is useful when the worksite BM 222 is in the field of view of the scanning LDM 16, 18. Since there is no PS sensor, this embodiment saves the effort of setting up a PS system (including providing a rotating laser transmitter that would create a laser plane at a predetermined elevation, for example).

Bench: Identify the BM from a profile—example:

The user may initiate a scan of the worksite while holding the sensing device static with no BM identified for a reference. The L centric vertical and horizontal point coordinates of the scan profile (V3*i* and H3*i*) will be determined (FIG. 10) by;

$$V3i=D3i*\cos(A3i) \quad \text{EQUATION 8:}$$

$$H3i=D3i*\sin(A3i) \quad \text{EQUATION 7 (again):}$$

The user may then identify the worksite bench mark feature relative to the displayed profile (such as an existing surface) by entering a mode that allows dragging or placing BM cross hairs at the desired location. The coordinates of the profile points will be aligned to the BM, hence the jobsite coordinates, and the latest profile and any design profile will be displayed BM centric (FIG. 8).

Example

Bench: Identify the BM with the LDM Sensing Output Beam (Bench Mode)

The user steers the LDM sensing output beam 20 to illuminate the BM 222 and initiates the bench function. The system will then display the BM centric features (as depicted in FIG. 8, for example). For scans made without moving the sensing device, the system displays the BM centric profiles as determined by:

With no PS; V0, V2, V4, H0, H2, and H4=0.

Substituting into E1 and E2 gives:

$$V1=V3 \quad \text{EQUATION 9:}$$

$$H1=-H3 \quad \text{EQUATION 10:}$$

And substituting these into E5 and E6 gives;

$$VR3i=V3-V3i=D3*\cos(AS+AT)-D3i*\cos(ASi+AT) \quad \text{EQUATION 11:}$$

$$HR3i=H3-H3i=D3*\sin(AS+AT)-D3i*\sin(ASi+AT) \quad \text{EQUATION 12:}$$

If the sensing device is moved after the bench is identified, or during the scan, subsequent profiles will be displayed Non centric. Note that, when using the system of the second embodiment, the same functions, operating modes, equations, and displays that were described above for the first embodiment are still available, with the extra limitation that there is no PS signal. The "penalties" of that extra limitation are described above. Note that, as an alternative, the sensing device could be mounted on the excavator's stick 208, its bucket cylinder 214, or on its platform 204, or other suitable member as desired.

(Note that the term "bench" or "benching," for this second embodiment, is the alignment of the sensors of the integrated sensing device system and sensing device output coordinates to the worksite coordinate system. There is no position sensor involved, only the steerable LDM and the EOS (angle reference) sensors.)

Third Embodiment

Figure 12:
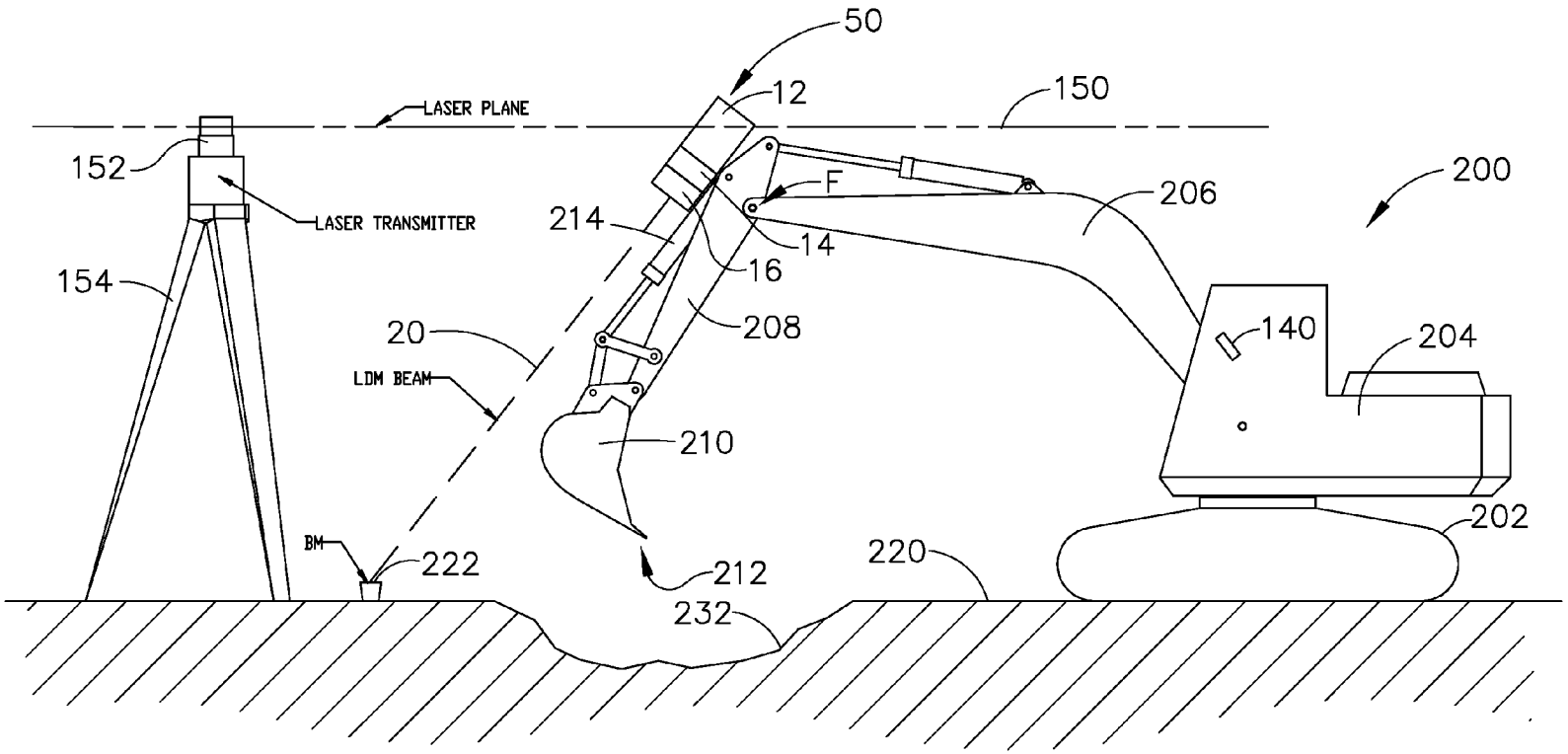
FIG. 12 is a diagrammatic view, depicted as a side elevational view, of an excavator earthmoving machine that has the integrated sensing device of FIG. 3 mounted to its dipper stick, showing the "dig site" being aimed at by the LDM, or showing the benchmark being illuminated during a benching procedure.

Referring now to FIG. 12, a sensing device 50 having the configuration of FIG. 3 with PS=LR is mounted to the stick 208 of an excavator 200 in this third basic system embodiment. The sensing device configuration of FIG. 3 has no steering mechanism, and relies on a member of the machine to steer it to points of interest. This sensing device configuration 50 saves the cost of the steering mechanism 18 and encoder 114, but of course, this system configuration requires many more movements of the machine's members to perform the scans of the target area.

The system of this third embodiment displays BM centric profiles when the PS 12 is working and the sensing device 50 is moved that are the same as those of the first embodiment sensing device 10. If the PS 12 is not working, the points or profiles are displayed non centric. Alternatively, for scans where the boom does not move during the scan, the device 50 could be mounted to the stick such that datum L or P aligns with the dipper pivot F, profiles could then be displayed BM centric when the PS signal is temporarily lost. Alternatively again, the third embodiment sensing device 50 could be mounted to bucket cylinder 214. Alternatively yet again, when using in the third embodiment sensing device 50, the PS 12 could be a GNSS receiver, a TTS target, or a GNSS receiver augmented with a LR.

Fourth Embodiment

Figure 13:
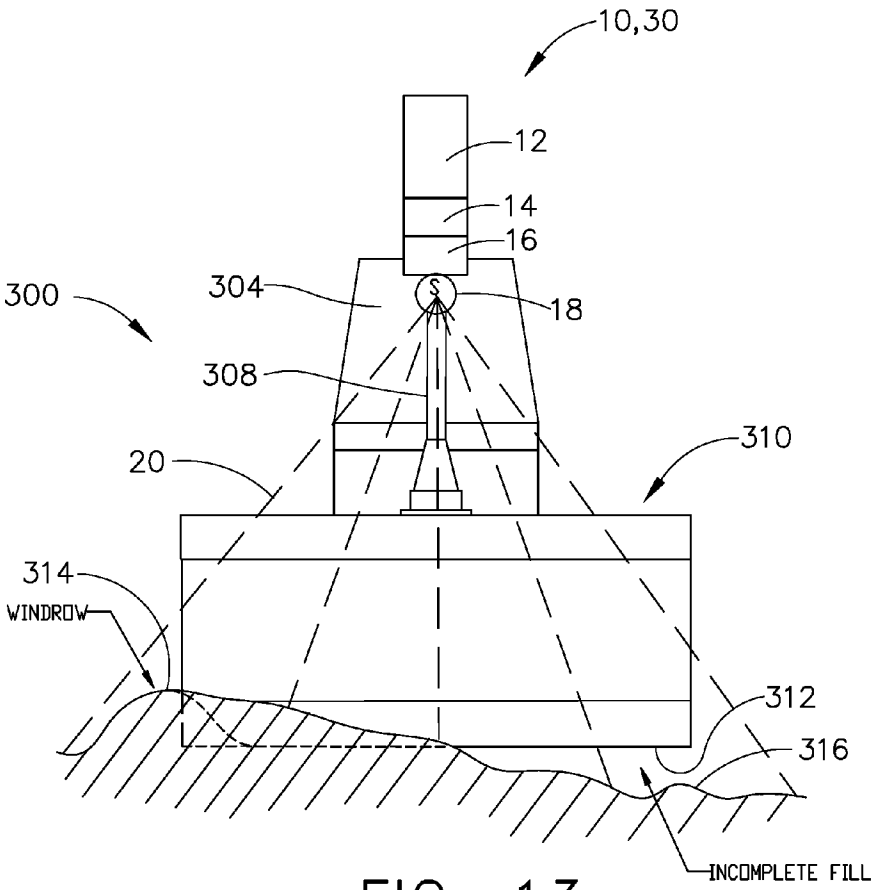
FIG. 13 is a diagrammatic view, depicted as a front elevational view, of a bulldozer earthmoving machine that has the integrated sensing device of either FIG. 1 or FIG. 2 mounted to a mast that is attached to the bulldozer's blade.
Figure 14:
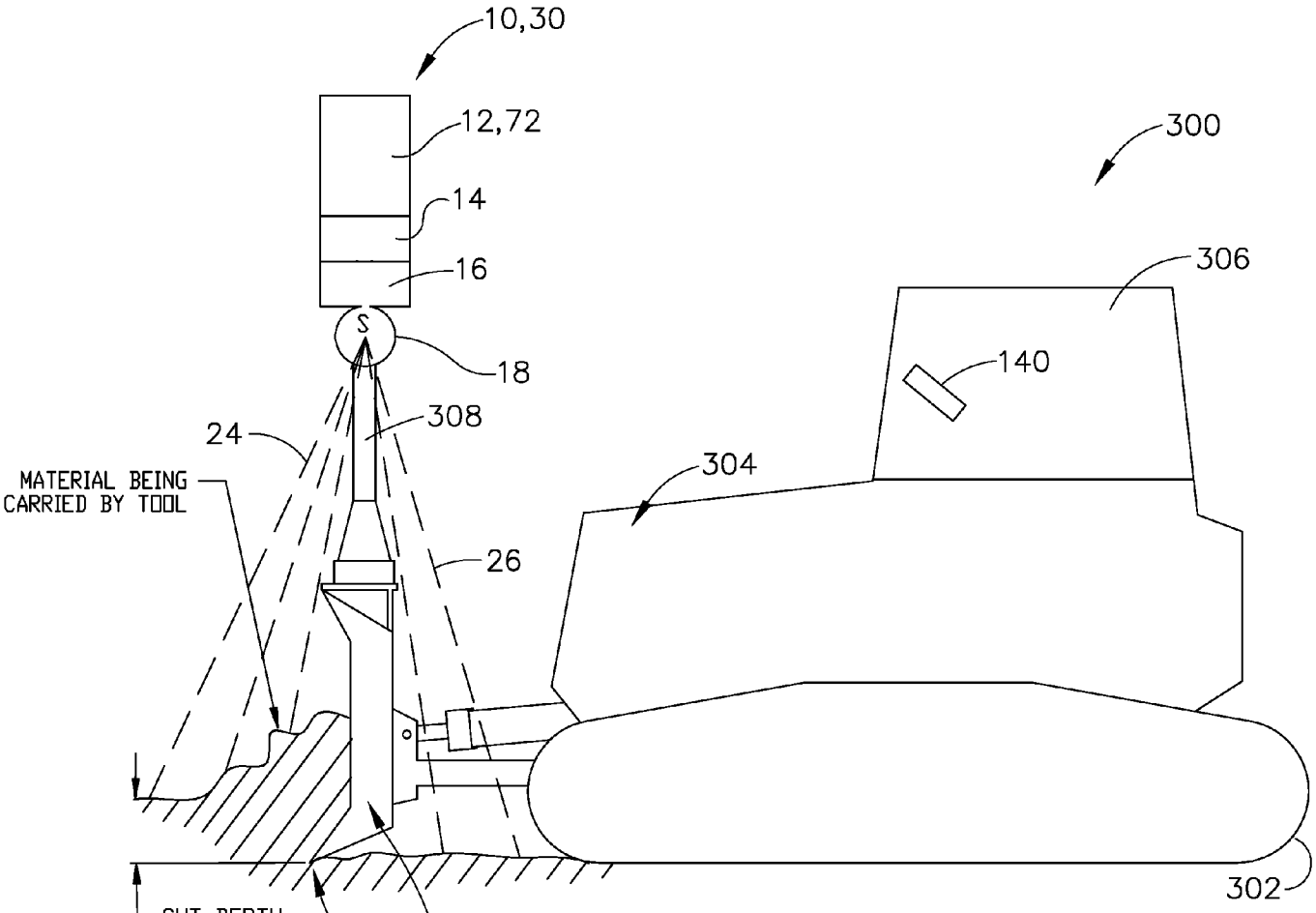
FIG. 14 is a diagrammatic view, depicted as a side elevational view, of the bulldozer earthmoving machine of FIG. 13.

FIGS. 13 and 14 show the sensing device 10 having a configuration as per FIG. 1, mounted to a mast 308 added to the blade 310 of an earth working machine, such as a bulldozer 300. Note that both the sensing device 10 of FIG. 1 and the sensing device 30 of FIG. 2 would successfully operate in this system.

The sensing device 10 could be oriented to scan "side-to-side" the material ahead or behind the length of the cutting edge as shown in FIG. 13. The guidance system could measure, display, and record the actual expected cut profiles as well as windrows or incomplete fill areas being left by the tool. If the PS 12=GNSS receiver or TTS target, the location of these areas could be "mapped." The guidance system with device 10 or 30 could also be used to have the tool match the elevation of existing material about one, or both, ends 314 and 316 of the cutting edge 312 of the working tool 310; i.e., the guidance system could produce signals to control the elevation of the cutting edge to match the elevation of the existing material on one or both sides (314 and/or 316) of the bulldozer's blade 310. A PS 12 is not required for this function. This is similar in function to TRACER products sold by Trimble (Model No. ST400). The system also could measure the blade slope of the finished material surface.

The sensing device 10 or 30 could be oriented to scan the material ahead and/or behind the working tool as shown in FIG. 14. The LDM laser scan lines 24 show the terrain ahead of the working tool, while the LDM laser scan lines 26 show the terrain behind the working tool. Using this function, the system could measure and display the amount of material being cut and or carried by the blade 310 to help the operator avoid stall conditions. Also, the system with device 10 could measure the actual elevation behind the cutting edge 312, or a compaction roller (for example), for materials that spring up after cutting and or compacting. As in some of the other embodiments, the sensing device 10 or 30 could be mounted to the machine platform 304 or some other member of the machine 300, and oriented to measure the cross slope of materials being worked.

Alternatively, the system may also perform a routine that scans the profile of the working tool while its cutting edge rests on a flat or other predetermined surface. That routine would then construct an image (a cross section) of the working tool 310 from the scan profile(s), with the cutting edge 312 determined by the flat surface. In later operation, the system would recognize a portion of the tool profile and place an image of the tool (with its cutting edge) at that position and orientation on the display monitor 140. Not only can the tool image be displayed in its current orientation, but also the monitor could show the distance between the working tool edge and the desired elevation (the design profile at this horizontal position on the jobsite surface).

Fifth Embodiment

Adding a Boom Pivot Reference

A fifth embodiment is provided which adds a boom pivot ("BP") reference to either of the first or second embodiments. Very often while moving earth about a jobsite, the normal (or "valid") PS (position sensor) signal is lost due to buildings, excavations, and trees obstructing the PS system signals, and preventing it from working. Also for machines like excavators, the platform of the machine is often static while the arm of the excavator repetitiously digs the excavation. For this situation, it would be advantageous for the system to determine a machine platform reference that can be used when the PS signal is momentarily or permanently lost. The point on the machine platform that will be used as this reference is the boom pivot (BP), first shown in FIG. 10. To determine the BP reference, two more variables are needed (as seen on FIG. 10):

D5=Distance from L to BP; "L" is the output datum for the LDM measurements.

A5*os*=Angle between device null reference ("n") and the vector D5.

When the system is benched and no PS signal present, it will determine BP location relative to BM by;

$$VBP=V3-V5=D3*\cos(A3)-D5*\cos(A5) \quad \text{EQUATION 13:}$$

$$HBP=H3+H5=D3*\sin(A3)+D5*\sin(A5) \quad \text{EQUATION 14:}$$

Where:

$$A5=A5os-AT \quad \text{EQUATION 15:}$$

If a PS signal is present the system will also determine V1 and H1 (per Equation 1 and Equation 2).

When the system receives the PS signal it will update VBP and HBP and keep the latest in memory, as per:

$$VBP=V0+V1-V2-V4-V5 \quad \text{EQUATION 16:}$$

$$HBP=H0-H1-H4-H2+H5 \text{ (not determined for } PS=LR) \quad \text{EQUATION 17:}$$

When the PS signal is not present, but the BP has not moved since bench or the last PS signal, the scan profiles can be determined and displayed BM centric by:

$$VR3i=VBP+V5-V3i \quad \text{EQUATION 18:}$$

$$HR3i=HBP-H5-H3i \text{ (not determined for } PS=LR, \text{ when } BP \text{ is moved after bench)} \quad \text{EQUATION 19:}$$

For systems with no PS signal (to update BP position), if the BP has moved after bench, displayed profiles revert to L centric.

BP Reference Calibration Procedure

The fifth embodiment adds a machine calibration procedure to the boom mounted sensing device of the "basic system" and provides certain additional features. A procedure is now described that determines the BP reference parameters D5 and A5*os*, taking advantage of the scanning LDM in the sensing device 10, 30, or 70, to minimize user effort. A PS sensor is not required. When benching the system, the user would repeat the bench function at two or more significantly different boom positions. The two or more extra benches could also be used to improve the accuracy of the bench parameters VBP and HBP by filtering the multiple solutions. (The term "filtering" loosely refers to taking multiple readings of the same points to create a summation that is averaged; it also includes the possibility of rejecting one or more data points that are outliers with respect to the other data points, and otherwise might skew the averaged readings.)

Figure 15:
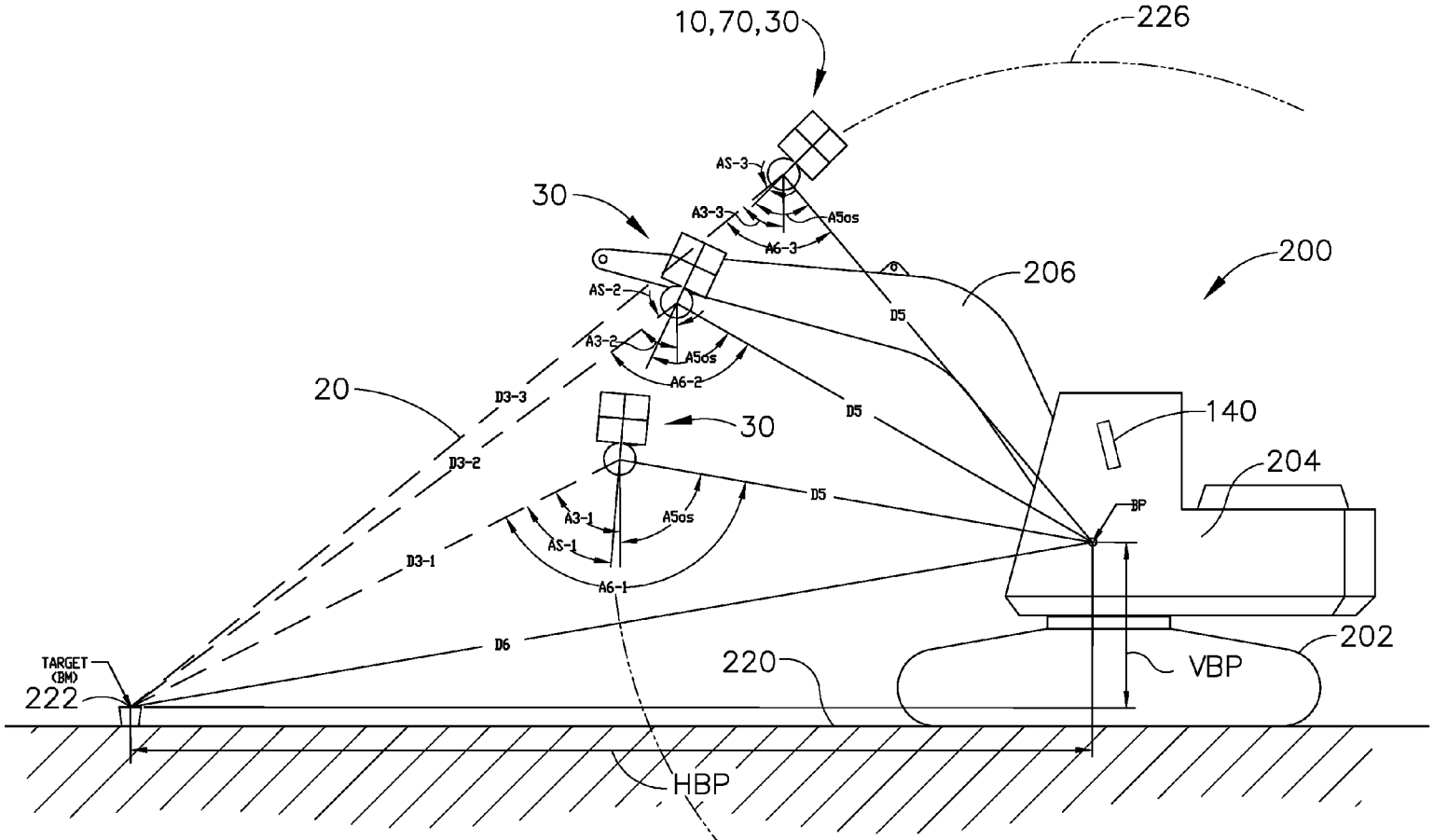
FIG. 15 is a diagrammatic view, depicted as a side elevational view, of an excavator earthmoving machine that has the integrated sensing device of a fifth embodiment of the instant technology mounted to its boom, showing multiple benching positions during a calibration procedure for the boom pivot reference.

Procedure:

(1) Bench the system at three or more significantly different boom positions, as shown in FIG. 15.

(a) Illuminate the BM 222 with the LDM 16 and initiate the bench function. A scanning routine that recognizes a target placed on the BM could be used to reduce user effort and increase accuracy. Such a target could be of a unique geometry or reflectivity, such as a reflective tape dot or strip.

(b) The system stores data from each of the boom positions (D3, A3, AS).

(2) The sensing device processor converts the L centric polar coordinates (D3, A3) for each boom position to BM centric Cartesian coordinates.

(3) The sensing device processor uses "three point circle fit" methods to determine the radius and center coordinates of the circular arc 226 formed by the LDM datum at the various boom positions. The circle radius=D5. The circle center coordinates=BP coordinates, relative to BM=(HBP, VBP).

(4) The sensing device processor determines the distance from BM to BP (distance D6) by the Pythagorean Theorem.

$$D6=\text{SQRT}(HBP\hat{}2+VBP\hat{}2) \quad \text{EQUATION 20:}$$

(5) The sensing device processor determines angle A6 by the law of cosines, for each of the boom positions.

$$A6=\arccos\{[(D3)\hat{}2+D5\hat{}2-D6\hat{}2]/[2*(D3)*D5]\} \quad \text{EQUATION 21:}$$

(6) The sensing device processor determines A5*os* for each of the boom positions by:

$$A5os=(A6)-(AS) \quad \text{EQUATION 22:}$$

(7) The sensing device processor filters the A5*os* solutions for each of the boom positions to improve the result.

(8) Repeat steps (2)-(7) for each of the "more than 3" boom positions. Filter the D5 and A5*os* solutions to improve the results.

It should be noted that, as an alternative methodology, the target for BP Reference calibration does not have to be the worksite BM. A suitable target could be any feature that (a) does not move during the procedure, (b) can be accurately located by the LDM, (c) is added or exists on the surrounding terrain or machine, and (d) has unique geometric and/or reflective properties that would allow it to be quickly and accurately located by manually steering, or an automated scanning routine. Moreover, as another alternative approach, different parameters could be stored during the procedure and different algorithms' could be used to solve for D5 and A5*os*. Yet another alternative approach would be, if the PS can provide the coordinates of the sensing device when positioned in the three or more boom positions, those coordinates could be used to solve for D5 and A5*os*, instead of target coordinates. (GNSS system receivers and TTS system targets can provide this, but a LR system cannot.)

It will be understood that this procedure could be used on machines other than excavators, when the sensing device 100 is mounted on a member that pivots about a point on another member that would make a suitably stable reference during the earth moving operations. An example of such other machines and members would be the arm member of a front end loader. It will also be understood that this procedure could be used with pitch and roll inclinometers added to the machine platform 204 and calibrated to the machine geometry to allow more accurate operation guidance when the machine platform is pivoted about its undercarriage 202.

Sixth Embodiment

Adding Bucket Tooth Location and Orientation

Figure 16:
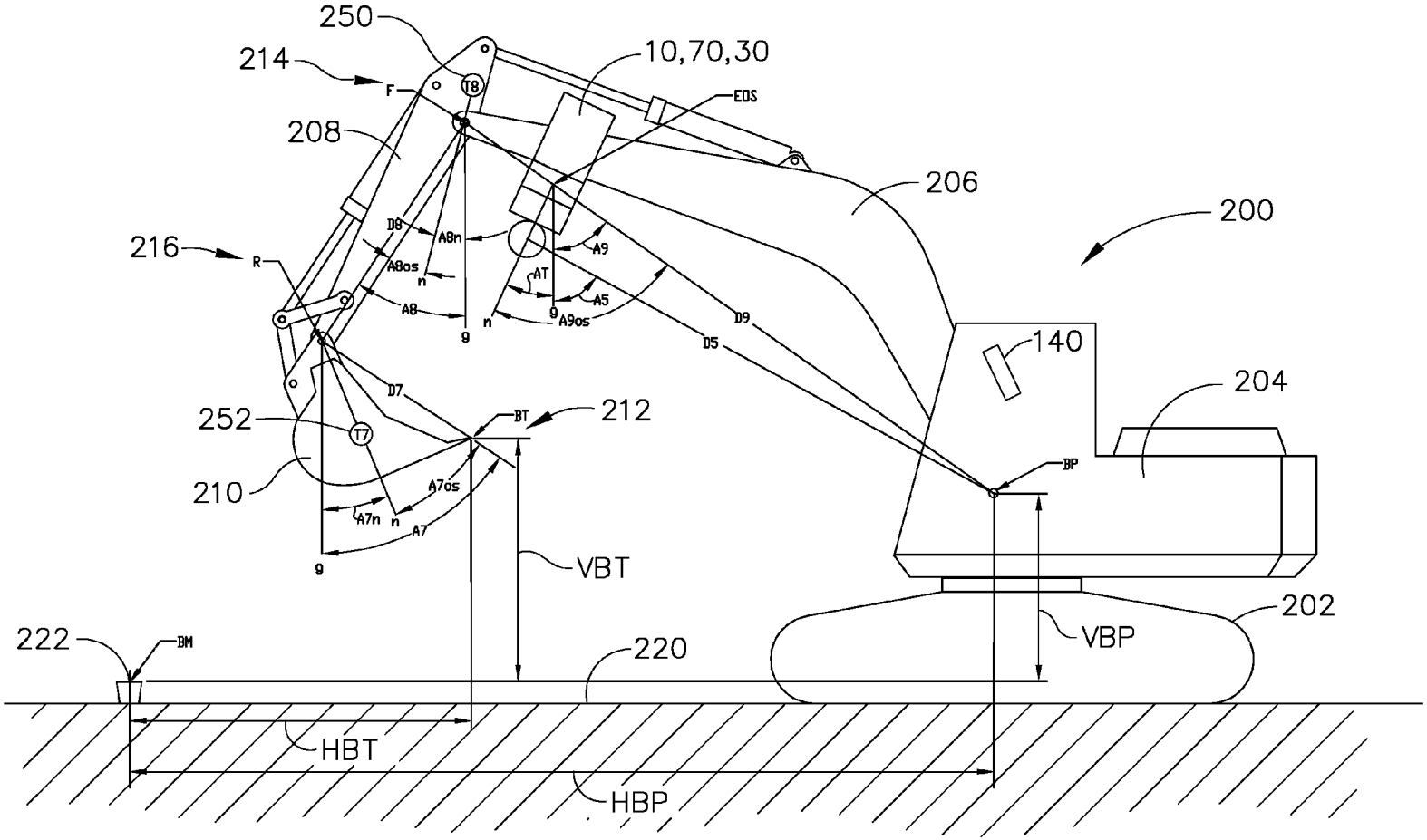
FIG. 16 is a diagrammatic view, depicted as a side elevational view, of an excavator earthmoving machine that has the integrated sensing device of a sixth embodiment of the instant technology mounted to its boom, with added inclinometer sensors mounted to the dipperstick and bucket.

For users of the system of the fifth embodiment who want bucket tooth location and orientation displayed along with terrain and design profiles, it is possible to add sensors to the excavating arm members and a new machine calibration procedure to accomplish this result. FIG. 16 shows a machine with the sensing device 10, 30, or 70 mounted to the boom 206 (similar to the fifth embodiment). Inclinometers 250 and 252 (also referred to as "T7" and "T8") are mounted at any appropriate safe location to the bucket 210 and stick 208 members. Note that the inclinometers could be augmented with gyros. In this embodiment, the sensing planes of the inclinometers are generally aligned to the swinging planes of the machine's members. This is easily done, as there are mounting surfaces on the members that align to the swinging planes. The null points of the inclinometers are imprecisely aligned to the vectors of each member.

The position of the bucket tooth can be found relative to the BM by:

$$VBT=VBP+D9*\cos(A9)-D8*\cos(A8)-D7*\cos(A7) \quad \text{EQUATION 23:}$$

$$HBT=HBP-D9*\sin(A9)-D8*\sin(A8)+D7*\sin(A7) \quad \text{EQUATION 24:}$$

As shown in FIG. 16, the vector angles A7, A8 and A9 are composites of the raw output of the inclinometers and an angular offset between the inclinometer null and the member vector. That leaves the member lengths (D7, D8 and D9) and inclinometer offsets (A7*os*, A8*os* and A9*os*) to be found. A new machine calibration procedure for this is now described.

Figure 17:
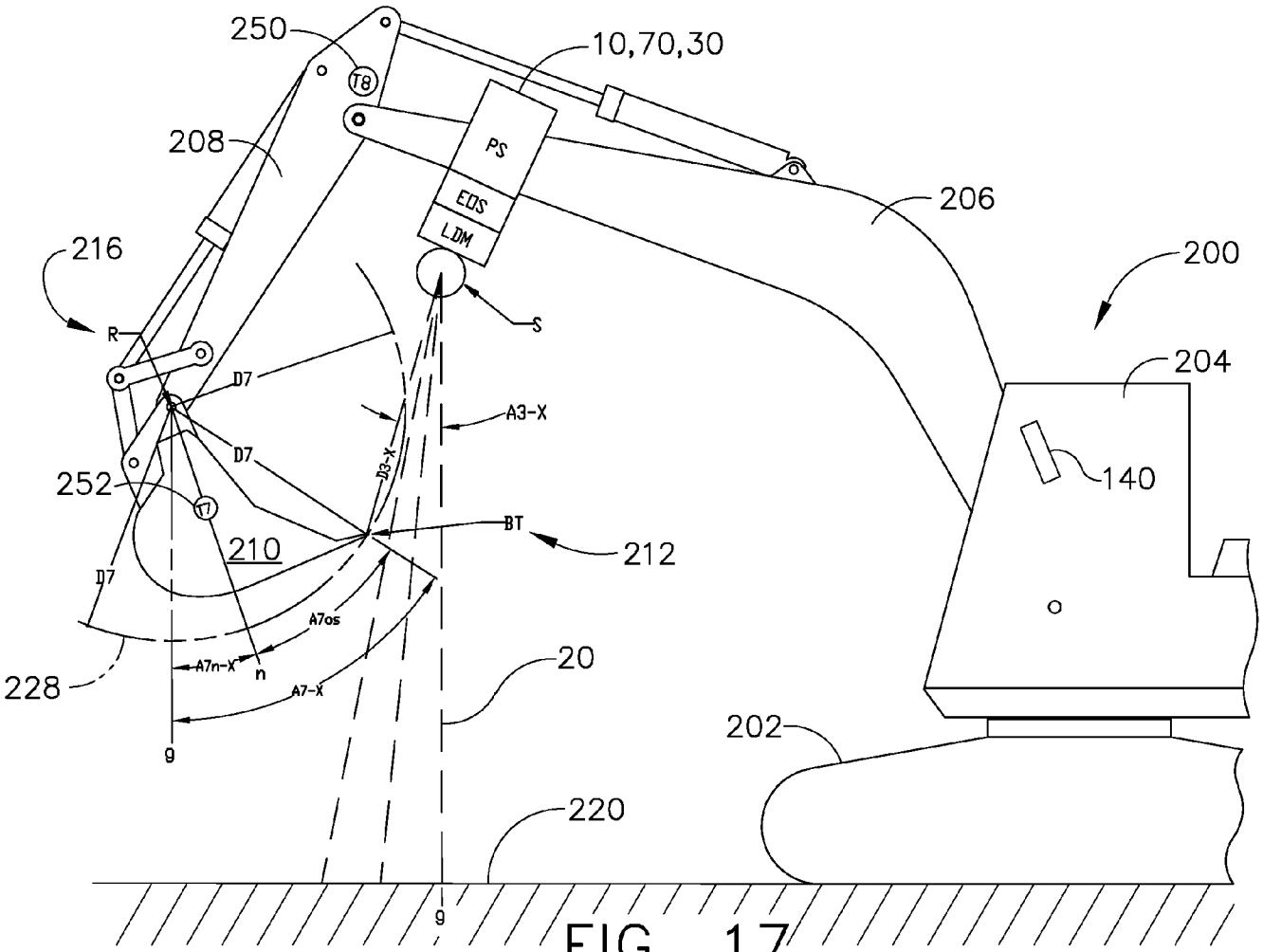
FIG. 17 is a diagrammatic view, depicted as a side elevational view, of the excavator earthmoving machine of FIG. 16, showing examples of multiple bucket positions during a bucket tooth calibration procedure.

Bucket Tooth Calibration Procedure (A) First determine the bucket parameters D7 and A7*os* (refer to FIG. 17).

D7=bucket vector length=vector from bucket pivot (R) to bucket tooth 240.

A7*os*=Angular offset between bucket inclinometer (T7) null and the bucket vector.

(a) Keep the machine static and the bucket held in the position shown (FIG. 17), outward of the sensing device 10 and substantially above smooth ground.

(b) A manual or automatic scanning routine is initiated to determine the bucket cutting edge location.

Figure 18:
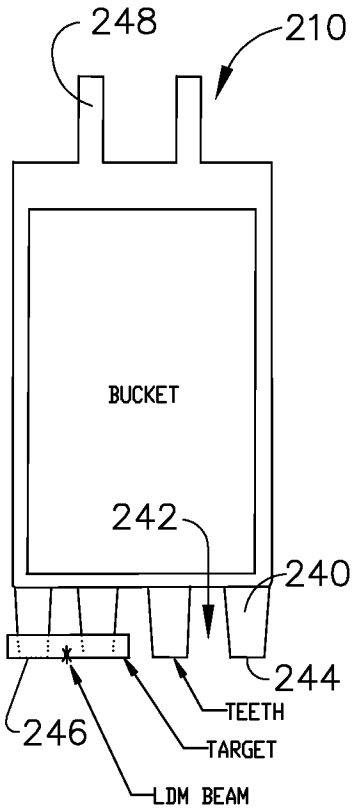
FIG. 18 is a diagrammatic view, depicted as a top plan view, of the excavator earthmoving machine of FIG. 17, showing more details of the bucket tooth calibration procedure.

The routine may start with the LDM sensing output beam aligned vertically and sweeps outward until the substantial distance change caused by the beam reflection "jumping" from the ground to the bucket tooth is encountered. The scanning routine will sweep back and forth over this point until it is determined with sufficient accuracy. A target 246 may be added to the bucket teeth 240 as shown in FIG. 18 to improve the following:

(1) The definition of the cutting edge from the often irregular teeth.

(2) The LDM sensing output beam alignment with the cutting edge (so it does not fall between the teeth).

(3) The routine reliability, location accuracy, and to minimize user effort required to determine the cutting edge location.

(4) The target could be of unique geometry or reflection properties.

Save in memory:

(1) D3=the distance from LDM datum to bucket cutting edge 244.

(2) A3=the angle from gravity reference to the cutting edge 244.

(3) A7*n*=the angle output of T7 (from null to gravity).

(c) Rotate only the bucket to two or more substantially different positions and repeat step (A)(b) at each.

(d) The sensing device processor transforms the LDM centric polar coordinates (D3, A3) of each bucket tooth position to Cartesian coordinates with respect to gravity.

(e) The sensing device processor uses "three point circle fit" methods to determine the radius and center of the circular arc 228 formed by the BT (bucket tooth) positions. The radius=D7; the center=bucket pivot R.

(f) For each bucket position, the processor determines the angle A7 of the bucket vector D7 with respect to gravity, from the coordinates of the bucket tooth and the bucket pivot.

(g) The sensing device processor determines A7*os* from:

$$A7os=(A7)-(A7n) \quad \text{EQUATION 25:}$$

(h) The A7*os*'s from each bucket position can be filtered to improve the results.

Figure 19:
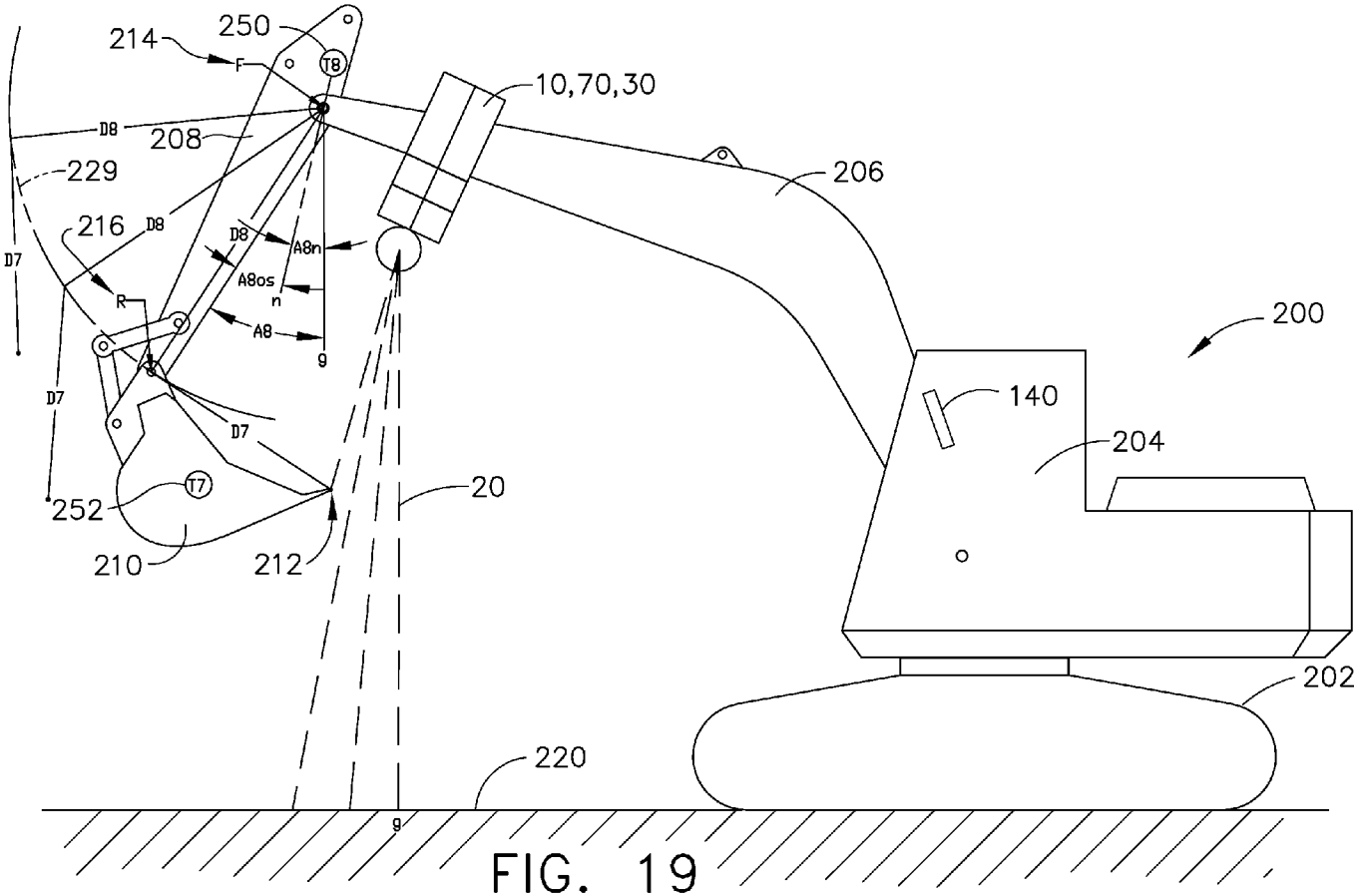
FIG. 19 is a diagrammatic view, depicted as a side elevational view, of the excavator earthmoving machine of FIG. 17, showing examples of multiple stick positions during the bucket tooth calibration procedure.

(B) Second, determine stick parameters D8 and A8*os* with a procedure similar to step (A). (Refer to FIG. 19.)

D8=stick vector length=vector from bucket pivot (R) to stick pivot (F).

A8*os*=Angular offset between stick inclinometer (T8) null and the stick vector.

(a) Keep the machine static and the bucket held in the position shown (see FIG. 19), outward of the sensing device 10 and substantially above smooth ground.

(b) A manual or automatic scanning routine is initiated, same as step (A)(b).

Save in memory:

(1) D3=the distance from LDM datum to bucket cutting edge 212.

(2) A3=Angle from gravity reference to cutting edge 212.

(3) A8*n*=Angle output of T8 (from null to gravity).

(4) A7=Bucket angle for the data gathering positions.

(c) Rotate the stick to two or more substantially different (data gathering) positions and repeat step (B)(b) at each. The bucket may be rotated as needed between stick positions, since D7 and A7 are known.

(d) The sensing device processor transforms the LDM centric polar coordinates (D3, A3) of each bucket tooth position to Cartesian coordinates with respect to gravity.

(e) The sensing device processor subtracts the bucket vector from the bucket tooth coordinates to give the stick point R coordinates.

(f) The sensing device processor uses three point circle fit methods to determine the radius and center of the circular arc 229 formed by the R positions. The radius=D8; the center=stick pivot F.

(g) For each data gathering stick position, the processor determines the angle A8 of the stick vector D8 with respect to gravity from the coordinates of the stick point R and the stick pivot F.

(h) The sensing device processor determines A8*os* from:

$$A8os=(A8)-(A8n) \quad \text{EQUATION 26:}$$

(i) The A8*os*'s from each bucket position can be filtered to improve the results.

(C) Third, the sensing device processor determines boom parameters D9 and A9*os*. (See FIG. 16.)

D9=boom vector length=vector from stick pivot (F) to boom pivot (BP).

A9*os*=Angular offset between sensing device EOS inclinometer (AT) null and the boom vector.

(a) Machine platform and boom are held static until the following calculations are completed.

(b) The coordinates of the stick pivot F are now known, and the coordinates of the boom pivot (BP) can be determined from D5 and A5 (as determined in the BP reference calibration section, above).

(c) The boom length (D9) and boom angle (A9) can be determined trigonometrically from these known points F and BP.

(d) The EOS-boom vector offset angle is determined by:

$$A9os=AT+A9 \quad \text{EQUATION 27:}$$

(D) The Bucket Tooth Location calibration is now complete.

Alternatively, the three calibration procedure steps that involved moving the machine members (determining BP reference parameters, determining bucket parameters, and determining stick parameters) could be combined to save user effort. All three machine members could be exercised simultaneously at each bucket tooth position, and the equations simultaneously solved. Another alternative would be to mount the sensing device 10 on the stick, with inclinometers mounted to bucket and boom. Similar equations of motion and calibrations procedures may be used in that configuration.

It will be understood that the sensing device of the technology disclosed herein could be applied to excavators or backhoes with more or less than 3 articulated members and to earth moving machines other than those mentioned above, such as front end loaders, box blades, graders, trenchers, compaction rollers, screeds, pavers, etc., without departing from the principles of this field of technology.

For the purpose of clarity in this disclosure, only 2D (two-dimensional) design and scanned profile display examples are shown. As noted above, however, the designs and scanned profiles could also be displayed in 3D (three dimensions).

Figure 20:
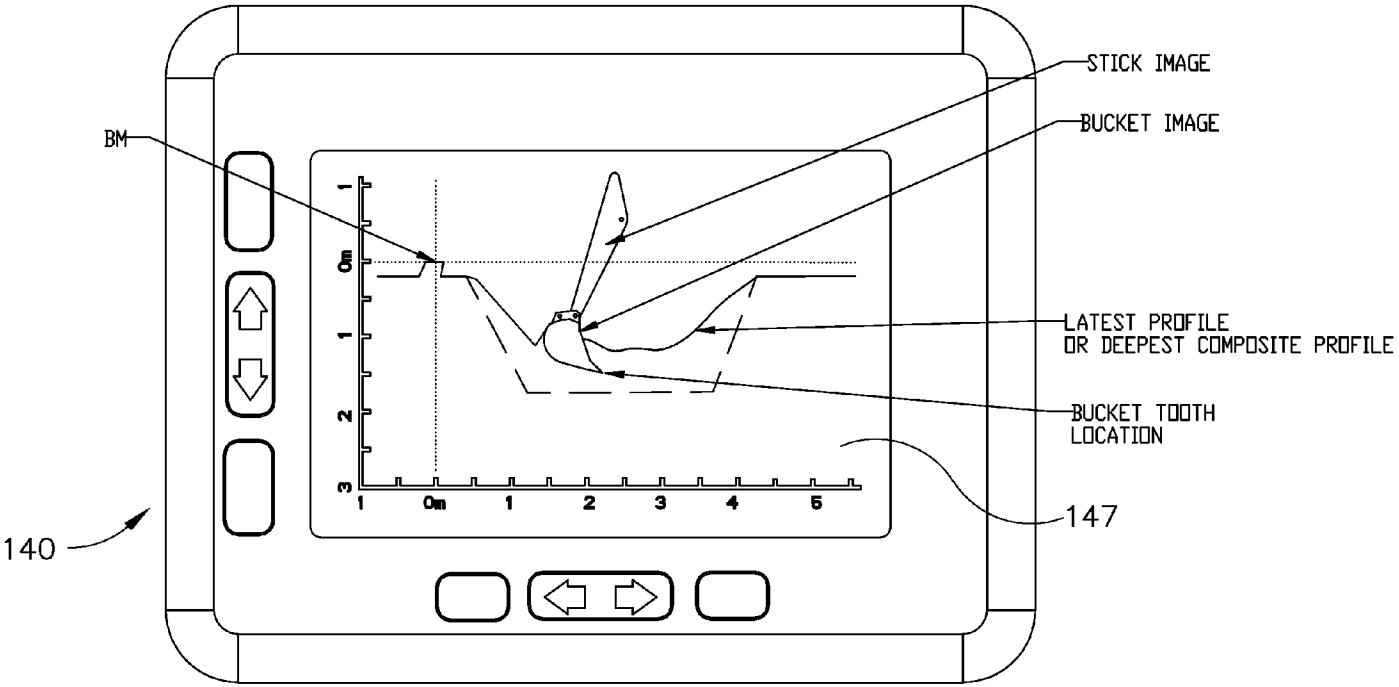
FIG. 20 is a diagrammatic "screen shot" view of an example display that is presented on a display monitor, used as part of the integrated sensing device of FIG. 16, showing both the latest profile and the current location of the bucket, both on the same Y-Z axes.

FIG. 20 shows a display monitor 140 in which the bucket tooth location could be represented by a point or a bucket image on the display screen 147, along with any of the mentioned profiles. A bucket image could be located by VBT and HBT, scaled by D7, and oriented by A7. Likewise the images of the stick and boom could also be added to the display. The system could also display measurements such as the vertical distance of the bucket tooth from a profile.

Referring now to the flowcharts of FIGS. 21, 22, and 23, which apply to embodiments 1, 2, and 5, the top half of each of these flowchart pages represents operator decisions that are to be made with respect to the particular needs of the excavation at hand, coupled with knowledge of the capabilities of the position sensing system available and the expected field conditions on jobsites where the sensing device will be used. The steps in the bottom half of these three flowchart pages (i.e., the half below the dashed line) represent decisions made automatically by the sensing device itself once it has begun operation with a particular piece of earthmoving equipment.

As will be understood from reading the description below, the operator decisions have more to do with excavation requirements, and position sensing system availability and limitations, rather than the model or make of the earthmoving equipment.

Referring now to FIG. 21, the flowchart begins at a step 400 in which the excavation design(s) is studied to select a sensing device with the proper configuration and type of position sensor that best meets the needs of that earth moving procedure and type of jobsite, which essentially involves a decision to select one of the four embodiments that are described on FIGS. 1-4. At a step 402, the excavation design criteria are now entered into the system. The sensing device is mounted to the earthmoving machine at a step 404. The display is now mounted to the machine at a step 406.

The logic flow has now arrived at a decision step 410, which determines whether or not a position sensor is being used. As discussed above, a typical position sensor used in the technology disclosed herein is either a laser receiver or a GNSS receiver, or a TTS target. If a position sensor is not being used, then, during machine operation, the logic flow is directed to a decision step 420 that asks whether or not the benchmark is a recognizable feature of the scan profile of the operator's display? If the answer is NO, then the bench routine is performed by identifying the benchmark with the LDM (laser distance meter) sensing output beam, at a step 424. The LDM sensing output beam is used to scan the worksite surface at a step 426, which may be initiated manually or automatically. A decision step 440 now determines whether or not the sensing device was moved during the scan. If YES, then a step 442 determines that the display mode on the operator's monitor will be "non centric," and logic flow returns to step 426.

If the sensing device was not moved during the scan, then the result at decision step 440 would be NO, and the logic is now directed to a decision step 450 that determines if the sensing device was moved since the bench procedure? If the answer is YES, then a step 452 will cause the operator's monitor to display the scanned profile in the "L centric" mode, and logic flow returns to step 426. If the answer was NO at step 450, then a step 434 will cause the operator's monitor to display the scanned profile in the "BM centric" mode (meaning it is benchmark centric), and logic flow returns to step 426.

As discussed above, the "L centric" display mode is used when a benchmark is not available, even though the sensing device was static during its scan. The profiles and points of interest are displayed relative to the LDM datum point "L", but no benchmark or benchmark crosshairs, or benchmark-related design features are displayed on the monitor. Thus, there would be no virtual benchmark available for the user in this mode. On the other hand—as might be expected—in the "BM centric" display mode, these benchmark features are available and are displayed on the operator's monitor.

Referring back to the decision step 420, if a benchmark is a recognizable feature of the scan profile, then the logic flow is directed to a scan step 422, which may be initiated manually or automatically, at which point the steerable laser distance meter scans the worksite surface. A decision step 430 now determines whether or not the sensing device moved during the scan. If the answer is YES, then the logic flow is directed to step 442, and the display mode for the scanned profile is "non centric," and logic flow returns to step 422. If the sensing device did not move during the scan, then the logic flow is directed to a decision step 432 which asks whether or not the operator desires to identify the benchmark from the scan profile. In essence, the operator determines whether or not a recognizable shape representing the physical benchmark should be determined from the actual data received by the laser distance meter during its steerable scan. If the answer is NO, then the logic flow is directed to the step 452, and the display mode is "L centric." The logic flow returns to step 422. On the other hand, if the answer was YES, then the logic flow is directed to step 434 and the display mode is "BM centric" (meaning benchmark centric), and the logic flow returns to step 422.

The BP reference and its effect on display mode is available for the "no PS" configuration of the sensing device, but was omitted from FIG. 21 (which has no PS logic) of the flow chart for purposes of brevity. The BP reference and its effects will be discussed in FIGS. 22 and 23 (which include a "PS present" portion) of the flow chart. The operator option to identify the BM from the displayed data after a scan, discussed in FIG. 21 of the flow chart, is available to sensing device configurations with a PS sensor, but likewise will be omitted from FIGS. 22 and 23 of the flow chart for purposes of brevity.

Referring back to decision step 410, if a position sensor is going to be used, then the logic flow is directed through "A", which then directs the logic flow to FIG. 22. This incoming logic flow is given the reference numeral 500, and arrives at a step 502 that sets up the position sensor system. The logic flow is directed now to a decision step 510 that asks which type of position sensor will be used. The answer typically will either be a laser receiver, a GNSS receiver, or possibly a "total tracking station" (also known as a "TTS") target. If the answer is a laser receiver, then the logic flow is directed to a decision step 520 in which the user determines whether or not the position sensor might be obstructed while scanning. If the answer is NO, then the logic flow is directed to a step 522 in which the benchmark procedure is performed with the position sensor, and the benchmark is identified with the LDM sensing output beam. The phrase "benchmarked with the position sensor" means that the laser receiver is within the laser plane that typically is emitted by a rotating laser transmitter that produces a laser plane on the jobsite. This allows the sensing device to align its output coordinates to known coordinates on the jobsite.

The next step is to scan the worksite surface, at a step 524, which can be initiated manually or automatically. A decision step 530 now determines whether or not the position sensor was working during the scan (e.g., the laser receiver was not within the laser plane). If not, a decision step 532 determines whether or not the sensing device moved during the scan. If the answer was YES, then the logic flow is directed to a step 534, the display mode for the operator's monitor is "non centric," and the logic flow returns to step 524. A non centric display mode means that the profile being displayed on the monitor can be plotted, but no scales are displayed. Since the laser receiver is not currently within the laser plane, the position of scanned points relative to a dynamic datum L are determined by the EOS sensor (i.e., the electronic orientation sensor).

If the sensing device did not move during the scan, then the result at decision step 532 was NO, and now a decision step 540 determines whether or not the sensing device has moved since the benching procedure. If the answer is YES, then a step 542 causes the monitor to display its results in the L centric mode, and the logic flow returns to step 524. If the answer was NO at step 540, then a step 546 displays information on the operator's monitor screen in a mode known as "BM centric." (See above description.) The logic flow returns to step 524. Relating back to the decision step 530, if the position sensor was working during the scan, then a step 552 displays the information on the operator's monitor in a mode known as "vertical BM centric and horizontal L centric" (see above descriptions), and logic flow returns to step 524.

Relating back to the decision step 520, if the position sensor will be obstructed while scanning, then the logic flow is directed to a step 526 in which the operator decides to bench with the position sensor, in which the benchmark is identified with the LDM sensing output beam; but additionally, a boom pivot reference (referred to herein as the "BP reference") is established. In other words, in addition to the sensing device, a boom pivot reference will be included, which requires a certain amount of calibration of the equipment to the actual excavating machine. This calibration only has to be performed once for a given installation and machine, as discussed in the description above.

Once the boom pivot reference has been added into the system information, a scanning procedure is performed at a step 528, which may be initiated manually or automatically. A decision step 550 now determines whether or not the position sensor was working during the scan. If the answer is YES, then the logic flow immediately drops down to step 552, the display is vertical BM centric and horizontal L centric, and the logic flow returns to step 528. If the position sensor was not working during the scan, then the logic flow is directed to a decision step 560 which determines if the boom pivot moved since the bench procedure or since the last valid position sensor signal. If the answer is NO, the logic flow is directed to step 552 and the display mode is vertical BM centric and horizontal L centric, and the logic flow returns to step 528. On the other hand, if the answer was YES, the logic flow is directed to a decision step 562 that determines whether or not the sensing device moved during the scan. If the answer is NO, the logic flow is directed to step 542, the display mode is L centric, and the logic flow returns to step 528. If the answer is YES, then the logic flow is directed to the step 534, the display mode is non centric, and the logic flow returns to step 528. Conditions where BM centric display modes may result from the sensing device with LR and BP reference configuration are possible but were omitted from the flow chart for purposes of brevity.

Referring back to decision step 510, if the type of position sensor will be either a GNSS receiver or a total tracking station target array, the logic flow is directed through letter "B" and arrives on FIG. 23 as a logic flow at arrow 600; a decision step 610 will now determine whether the position sensor is expected to be obstructed while scanning. If the answer is NO, then a step 612 will perform the benching procedure with the position sensor working properly, and the physical benchmark will be identified using the LDM sensing output beam. A step 614, which may be initiated manually or automatically, now scans the jobsite surface.

A decision step 620 now determines whether the position sensor was working during the scan. If the answer is YES, then the logic flow is directed to a step 642, and the operator's monitor will operate in the display mode "BM centric." This is the "best" type of operation mode available, and all information will be displayed as per the principles of the technology disclosed herein. The logic flow then returns to step 614.

However, if the answer was NO at decision step 620, then the logic flow is directed to a decision step 622 that determines whether the sensing device moved during the scan. If the answer is YES, the logic flow is directed to a step 624 in which the display mode is "non centric," and the logic flow then returns to step 614. But if the sensing device did not move at step 622, then the logic flow is directed to a decision step 630 that determines if the sensing device has moved since the benching procedure. If the answer is NO, then the logic flow is directed to step 642, and the display mode is BM centric, and the logic flow is returned to step 614. On the other hand, if the sensing device has moved since the bench procedure, then the logic flow is directed to a step 632, and the display mode is "L centric," and the logic flow is returned to step 614.

Referring back to decision step 610, if the position sensor will be obstructed while scanning, then the logic flow is directed to a step 616 and the benching procedure is performed with the position sensor actively working, and the benchmark is identified with the LDM sensing output beam. The boom pivot reference is established, as was described in detail, hereinabove.

Once the benching procedure has been accomplished, the jobsite surface is now scanned with the LDM sensing output beam, upon manual or automatic initiation, at a step 618. A decision step 640 now determines whether the position sensor was working during the scan. If the answer is YES, the logic flow immediately drops down to step 642, the display mode is BM centric, and the logic flow returns to step 618. On the other hand, if the answer is NO, then a decision step 650 now determines whether the boom pivot has moved since the benching procedure, or since the last reliable position sensor signal was received. If the answer is NO, then the logic flow is directed to step 642, the display mode is again BM centric, and the logic flow returns to step 618.

If the boom pivot has moved since the bench procedure or the last reliable position sensor signal, then the result will be YES at decision step 650 and at decision step 652, which determines whether the sensing device moved during the scan. If the answer is NO at step 652, then the logic flow is directed to step 632, the display mode is L centric, and the logic flow returns to step 618. On the other hand, if the sensing device moved during this scan, the result at step 652 will be YES, and the logic flow is directed to step 624, the display mode is non centric, and the logic flow returns to step 618.

As can be understood from reading the description of these flowcharts, the decisions that are made by the equipment must to some extent be anticipated during the setup of the system. In other words, it will be known by the operator whether or not a laser receiver will be used as compared to a GNSS receiver, so that will bring the initial logic flow to either FIG. 22 or FIG. 23, for example. The information about whether or not a position sensor is being used (at step 410) will also be known well in advance by the operator.

However, some of the other major decisions are types that must be anticipated in advance, because it will not necessarily be known whether or not these conditions will exist on the jobsite. However, it can pretty well be figured out by most experienced operators as to whether or not the system will have some trouble recognizing a benchmark feature, or whether or not a position sensor will be obstructed while it is scanning. These are incidental considerations that perhaps will seem like minor considerations in advance, but realistically must be accounted for. The operating software of the sensing device of the technology disclosed herein will be able to handle such situations, merely by showing the appropriate one of the various types of display modes that can be made available to the machine operator.

It will be understood that the logical operations described in relation to the flow charts of FIGS. 21-23 can be implemented using sequential logic (such as by using microprocessor technology), or using a logic state machine, or perhaps by discrete logic; it even could be implemented using parallel processors. One preferred embodiment may use a microprocessor or microcontroller (e.g., microprocessor 110) to execute software instructions that are stored in memory cells within an ASIC. In fact, the entire microprocessor 110, along with RAM and executable ROM, may be contained within a single ASIC, in one mode of the technology disclosed herein. Of course, other types of circuitry could be used to implement these logical operations depicted in the drawings without departing from the principles of the technology disclosed herein. In any event, some type of processing circuit will be provided, whether it is based on a microprocessor, a logic state machine, by using discrete logic elements to accomplish these tasks, or perhaps by a type of computation device not yet invented; moreover, some type of memory circuit will be provided, whether it is based on typical RAM chips, EEROM chips (including Flash memory), by using discrete logic elements to store data and other operating information, or perhaps by a type of memory device not yet invented.

It will also be understood that the precise logical operations depicted in the flow charts of FIGS. 21-23, and discussed above, could be somewhat modified to perform similar, although not exact, functions without departing from the principles of the technology disclosed herein. The exact nature of some of the decision steps and other commands in these flow charts are directed toward specific future models of sensing and control system devices used with earthmoving equipment (those involving laser receivers sold by Trimble Navigation Limited, for example) and certainly similar, but somewhat different, steps would be taken for use with other models or brands of sensing or control systems in many instances, with the overall inventive results being the same.

Figure 24:
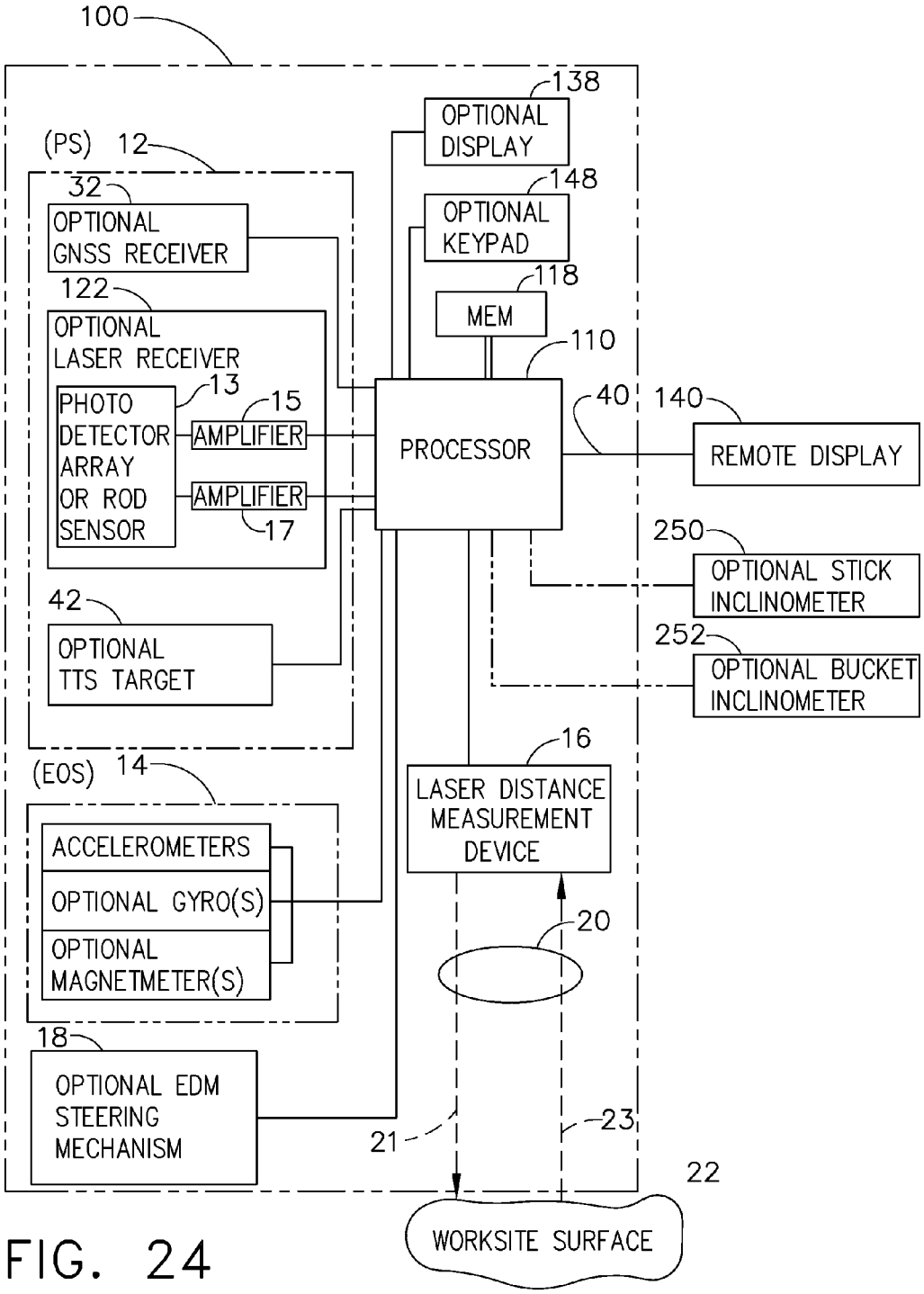
FIG. 24 is a block diagram of the major components of the integrated sensing devices of FIGS. 1-6 and other components of the guidance system, mounted to the earthmoving machines of FIGS. 1, 7, 10-19.

FIG. 24 is a hardware block diagram that depicts many of the major electronic components for the integrated sensing device 100. In sensing device 100, the optional laser receiver 122 includes either a photodetector array or a rod sensor, which are used to detect the position in which the laser plane 150 is intersecting the sensing device 100. On FIG. 24, the photosensors are generally depicted by the reference numeral 13. Typically, such a photodetector array or rod sensor will have two outputs, and each output is directed through an individual amplifier 15 or 17. These signals are directed to some type of microprocessor or microcontroller at 110, which will typically contain at least one analog-to-digital converter (also called an "ADC"), which converts the signals from the outputs of the amplifiers 15 and 17 into digital numbers. The processing circuit 110 will have some associated memory elements that are generally depicted at the reference numeral 118, as a memory circuit. If the processor 110 is a microcontroller, the memory elements 118 will typically be on-board that processor chip; however, that is not required.

One of the other sensing devices on FIG. 24 is the electronic orientation sensor 14, which is an angle-sensing device that can provide an output signal to the processor 110 that is related to the angle of this integrated sensing device with respect to the vertical (which is sensed as the direction of gravity) and optionally the angle of the device with respect to magnetic north (which is sensed as the direction of the local magnetic field). Another sensing device is the laser distance measurement device 16, which acts as the laser distance meter (LDM) that was discussed above. On FIG. 24, the laser distance meter 16 is schematically depicted as having an emission light beam at 21 that is directed toward a target (typically the jobsite ground surface at 22), and some of that emission beam 21 will be reflected back as a reflective light beam 23. On FIG. 24, the combination of the output emission beam 21 and the reflective incoming beam 23 are generally designated by the reference numeral 20.

The processor 110 has several devices it sends output signals to, including an optional local display 138 that can give the operator readout information, such as the position of the laser plane that is intersecting the photodetector sensors. There also is an optional small beeper (not shown) to get the attention of the operator, as needed. And finally, the sensing device has an optional keypad at 148, which allows the operator to set up the sensing device and put it into a particular operating mode, as desired. In addition to the above "on-board" output devices, there is a communications circuit 40 that sends signals to the remote display 140, which is the device that is positioned proximal to the operator of the earthmoving machine. Communications circuit 40 can be either a wireless device, or a "wired" device.

Yet another possible sensor is the optional stick angle sensor 250, which typically would be mounted on the dipperstick 208 of the excavator 200, and also typically would be a gravity sensing device (i.e., an inclinometer). And again, another possible sensor is the optional bucket angle sensor 252, which typically would be mounted on the bucket 210 of the excavator 200, and typically would be a gravity sensing device (i.e., an inclinometer).

As noted above, one possible position sensor 12 is a GNSS receiver, which is depicted at 32 on FIG. 24. The GNSS receiver 32 can provide one-dimensional, two-dimensional, or three-dimensional information to the processing circuit 110. The GNSS receiver 32 may be either a primary feature (in lieu of a laser receiver), or it may be an optional feature. As an optional feature, it can be useful for situations where the laser receiver provides the vertical information (at higher accuracy than the GNSS receiver) and the GNSS receiver provides horizontal information. Or laser receiver portion 12 of the sensing device 100 suddenly finds itself outside the laser plane 150. In that event, the height dimension can temporarily be determined by the GNSS receiver 32.

As noted above, another possible position sensor 12 is a tracking total station (TTS) target, which is depicted at 42 on FIG. 24. The TTS target 42 and supporting system can provide one-dimensional, two-dimensional, or three dimensional information to the processing circuit 110. The optional LDM steering mechanism 18 receives commands from the processor 110 to move the LDM sensing output beam. It also provides feedback information on the orientation of the LDM sensing output beam to the processing circuit 110.

As may be used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an Y-Z (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Or, two or more possible locations for a particular point can be specified in relation to a precise attribute of a physical object, such as being "near" or "at" the end of a stick; all of those possible near/at locations could be deemed "proximal" to the end of that stick. Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

All documents cited in the Background and in the Detailed Description are, in relevant part, incorporated herein by reference; the citation of any document is not to be construed as an admission that it is prior art with respect to the technology disclosed herein.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. An integrated sensing device for use with an earthmoving machine that includes a working tool edge, said integrated sensing device comprising:

(a) an electronic distance sensor, having a sensing output that is directed at a jobsite surface, which determines a distance between a datum of said sensing output and said jobsite surface without making physical contact with said jobsite surface;

(b) an electronic orientation sensor for detecting an angular orientation of said sensing output; and (c) a processing circuit, and a memory circuit;

(d) wherein said processing circuit is configured:

(i) to receive output signals from said electronic distance sensor and said electronic orientation sensor;

(ii) to determine the distances between said datum and a plurality of physical points on said jobsite surface, and to generate a "latest profile" that represents an actual shape of said jobsite surface; and (iii) to send signals to said visible monitor screen, so as to display said "latest profile".

2. The integrated sensing device of claim 1, wherein said processing circuit is further configured to control said visible monitor screen so as to display operational information in at least one of the following modes:

(a) BM centric;

(b) L centric;

(c) Vertical BM centric and Horizontal L centric; and (d) Non centric.

3. The integrated sensing device of claim 1, wherein said electronic distance sensor comprises a laser distance meter.

4. The integrated sensing device of claim 1, wherein said electronic orientation sensor comprises at least one of:

(a) at least one accelerometer;

(b) at least one gyroscope; and (c) at least one magnetometer;

and wherein said orientation sensor acts as an inclinometer based on direction of gravity.

5. The integrated sensing device of claim 1, further comprising a housing, wherein:

(a) said electronic distance sensor, said electronic orientation sensor, said processing circuit, and said memory circuit are all installed with said housing at a time of manufacture of said integrated sensing device;

(b) said electronic distance sensor and said electronic orientation sensor are both calibrated to said datum and to a direction of gravity without need of earthmoving machine geometry knowledge;

(c) said integrated sensing device is later mounted to an earthmoving machine; and (d) immediately thereafter, said integrated sensing device is ready for use without need for any calibration to said earthmoving machine.

6. The integrated sensing device of claim 1, further comprising a steering mechanism that, under the control of said processing circuit, aims said electronic distance sensing output so as to measure a plurality of distances to said jobsite surface at a plurality of aiming angles;

wherein: said integrated sensing device determines a difference between: (i) a direction of gravity, and (ii) a direction of said sensing output of the electronic distance sensor.

7. The integrated sensing device of claim 6, wherein, at any particular time, said steering mechanism, under the control of said processing circuit, aims said electronic distance sensor toward one of:

(a) ahead of a direction of movement of a working tool edge of said earthmoving machine;

(b) behind a direction of movement of a working tool edge of said earthmoving machine; and (c) to the side of a direction of movement of a working tool edge of said earthmoving machine.

8. The integrated sensing device of claim 6, further comprising:

(a) a first inclinometer sensor mounted to a dipperstick of an excavator earthmoving machine; and (b) a second inclinometer sensor mounted to a bucket of an excavator earthmoving machine;

(c) wherein said processing circuit is further configured:

(i) to determine a "design profile" for a predetermined digging operation, and to store said design profile in said memory circuit;

(ii) to receive output signals from said first and second inclinometer sensors;

(iii) to receive first reference information about geometries of said dipperstick, said bucket, and a boom of an excavator earthmoving machine, and to store said received dipperstick geometry first reference information, said bucket geometry first reference information, and said boom geometry first reference information in said memory circuit;

(iv) to receive second reference information about said first inclinometer sensor, said second inclinometer sensor, and said sensing device electronic orientation sensor, by way of a calibration function that is performed with said excavator earthmoving machine, and to store said first inclinometer sensor second reference information, said second inclinometer sensor second reference information, and said sensing device electronic orientation sensor second reference information in said memory circuit;

(v) based upon said first inclinometer output signal, second inclinometer output signal, sensing device electronic orientation sensor output signal, first reference information, and said second reference information, to determine a physical position of said bucket, including a working tool edge of said bucket; and (vi) to control said visible monitor screen so as to display both said physical position of said bucket working tool edge and at least one of:

(A) said latest profile, and (B) said design profile;

on a single set of coordinate axes, thereby showing a physical relationship between (C) said working tool edge, and (D) at least one of said latest profile and said design profile.

9. The integrated sensing device of claim 8, wherein during said calibration function: (a) while said dipperstick of an excavator earthmoving machine, said bucket of an excavator earthmoving machine, and said boom of an excavator earthmoving machine are placed in several different positions; and (b) while said sensing output of the electronic distance sensor is aimed to illuminate a target;

(c) said processing circuit is further configured to determine, based upon said output signals from said first inclinometer, said second inclinometer, said electronic distance sensor, and said electronic orientation sensor, said first reference information and said second reference information.

10. The integrated sensing device of claim 1, wherein said processing circuit is further configured:

(a) to determine a "design profile" for a predetermined digging operation, and to store said design profile in said memory circuit;

(b) to send signals to said visible monitor screen, so as to display said design profile; and (c) during operation, to control said visible monitor screen so as to display both said latest profile and said design profile on a single set of coordinate axes, thereby showing a physical relationship between both said latest profile and said design profile for said predetermined digging operation.

11. The integrated sensing device of claim 10, further comprising at least one of: (i) an electronic position sensor for detecting elevation, and (ii) a steering mechanism that, under the control of said processing circuit, aims said electronic distance sensing output so as to measure a plurality of distances to said jobsite surface at a plurality of aiming angles;

wherein said processing circuit is further configured:

(a) to determine working tool physical profile information, and to identify the working tool edge of said working tool physical profile;

(b) during operation, to recognize a portion of said working tool physical profile information if encountered in said latest profile, then said processing circuit is further configured;

(i) to send output signals to said visible monitor screen, so as to display an image of said working tool edge in its recognized position;

(ii) to control said visible monitor screen, so as to display both said position of said working tool edge and at least one of:

(A) said latest profile, and (B) said design profile, on a single set of coordinate axes, thereby showing a physical relationship between said working tool edge and at least one of said latest profile and said design profile.

12. The integrated sensing device of claim 1, further comprising at least one of: (i) an electronic position sensor for detecting elevation, and (ii) a steering mechanism that, under the control of said processing circuit, aims said electronic distance sensing output so as to measure a plurality of distances to said jobsite surface at a plurality of aiming angles;

wherein:

(a) said processing circuit is further configured:

(i) to receive boom pivot reference information, by way of a calibration function that is performed with an earthmoving machine; and (ii) to store said received boom pivot reference information in said memory circuit; and (b) during operation, if said position sensor output signal is lost from said electronic position sensor, and if a boom pivot of said earthmoving machine has not moved since: (A) the last valid position sensor output signal was received or (B) a benching procedure was performed, or both, then said processing circuit is further configured:

(i) to determine said latest profile with boom pivot reference information;

(ii) to determine a "design profile" for a predetermined digging operation, and to store said design profile in said memory circuit;

(iii) to send output signals to said visible monitor screen, so as to display said design profile; and (iv) to control said visible monitor screen so as to display both said latest profile and said design profile on a single set of coordinate axes, thereby showing a physical relationship between both said latest profile and said design profile for said predetermined digging operation, without relying on said position sensor output signal.

13. The integrated sensing device of claim 12, wherein during said calibration function, said processing circuit is further configured:

(a) to receive output signals from said electronic distance sensor and said electronic orientation sensor, while:

(i) a member of said earthmoving machine is placed in a plurality of positions; and (ii) said electronic distance sensor is aimed to illuminate a particular suitable target at each of said plurality of positions; and (b) to determine said boom pivot reference information from said output signals.

14. The integrated sensing device of claim 1, further comprising at least one of: (i) an electronic position sensor for detecting elevation, and (ii) a steering mechanism that, under the control of said processing circuit, aims said electronic distance sensing output so as to measure a plurality of distances to said jobsite surface at a plurality of aiming angles;

wherein said processing circuit is further configured:

(a) after determining said latest profile;

(b) to allow an operator of said earthmoving machine to visually identify and select a feature of known jobsite coordinates relative to said displayed latest profile, and to designate said selected feature as a designated benchmark for said jobsite surface; and (c) to change coordinates of said latest profile so the latest profile will be aligned to said designated benchmark and therefore aligned to jobsite coordinates, then:

(i) to determine a "design profile" for a predetermined digging operation, and to store said design profile in said memory circuit;

(ii) to send output signals to said visible monitor screen, so as to display said design profile; and (iii) during operation, to control said visible monitor screen so as to display both said latest profile and said design profile on a single set of coordinate axes, thereby showing a physical relationship between both said latest profile and said design profile for said predetermined digging operation.

15. The integrated sensing device of claim 1, further comprising: an electronic position sensor for detecting elevation, wherein said processing circuit is further configured to receive a position sensor output signal from said electronic position sensor.

16. The integrated sensing device of claim 15, wherein said electronic position sensor comprises at least one of:

(a) a laser receiver having at least one photosensor, said laser receiver detecting a position of incoming laser light that reaches said at least one photosensor; and (b) a GNSS receiver that detects a position based upon incoming signals from a constellation of satellites; and (c) a target array of a tracking total station system (TTS).

17. The integrated sensing device of claim 15, wherein said electronic position sensor comprises a GNSS receiver antenna, and further comprising:

a pivotable mount that allows said GNSS receiver antenna to be steered.

18. The integrated sensing device of claim 15, wherein said integrated sensing device is mounted to a movable member of an earthmoving machine, and an operator of said earthmoving machine controls said movable member so as to aim said electronic distance sensor to measure a plurality of distances to said jobsite surface at a plurality of aiming angles.

19. A method for using an integrated sensing device with an earthmoving machine that includes a working tool edge, said method comprising:

(a) providing an integrated sensing device, having:

(i) an electronic distance sensor;

(ii) an electronic orientation sensor;

(iii) a processing circuit; and (iv) a memory circuit;

(b) directing a sensing output of said electronic distance sensor toward a jobsite surface, and determining a distance between a datum of said sensing output and said jobsite surface without making physical contact with said jobsite surface;

(c) detecting an angular orientation of said sensing output, using said electronic orientation sensor;

(d) receiving output signals from said electronic distance sensor and said electronic orientation sensor, determining the distances between said datum and a plurality of physical points on said jobsite surface, and generating a "latest profile" that represents an actual shape of said jobsite surface; and (e) sending signals to a visible monitor screen, and displaying said latest profile.

20. The method of claim 19, further comprising the steps of:

(a) determining a "design profile" for a predetermined digging operation;

(b) storing said design profile in said memory circuit; and (c) during operation, displaying both said latest profile and said design profile on a single set of coordinate axes on said visible monitor screen, thereby showing a physical relationship between both said latest profile and said design profile, for said predetermined digging operation.

21. A method for using an integrated sensing device with an earthmoving machine that includes a working tool edge, said method comprising:

(a) providing an integrated sensing device, having:

(i) an electronic distance sensor;

(ii) an electronic orientation sensor;

(iii) a processing circuit;

(iv) a memory circuit; and (v) a housing;

(b) calibrating said electronic distance sensor and said electronic orientation sensor to a datum of said electronic distance sensor and to a direction of gravity without need of earthmoving machine geometry knowledge;

(c) later, mounting said integrated sensing device to an earthmoving machine;

(d) thereafter, without need for any calibration to said earthmoving machine, determining the distances between said datum and a plurality of physical points on a jobsite surface, and generating a "latest profile" that represents an actual shape of said jobsite surface; and (e) sending signals to a visible monitor screen, and displaying said latest profile.

* * * * *